US009375648B2

(12) United States Patent
Hippely et al.

(10) Patent No.: US 9,375,648 B2
(45) Date of Patent: Jun. 28, 2016

(54) TOY VEHICLE

(75) Inventors: Keith Alan Hippely, Manhattan Beach, CA (US); Joseph Wu, Torrance, CA (US); Patrick Chu, Kowloon (CN); Denise Wong, Kowloon (CN); Edward Wong, Kowloon (CN)

(73) Assignee: Mattel, Inc., El Segundo, CA (US)

( * ) Notice: Subject to any disclaimer, the term of this patent is extended or adjusted under 35 U.S.C. 154(b) by 814 days.

(21) Appl. No.: 13/117,534

(22) Filed: May 27, 2011
(Under 37 CFR 1.47)

(65) Prior Publication Data

US 2014/0248821 A1 Sep. 4, 2014

Related U.S. Application Data

(60) Provisional application No. 61/349,634, filed on May 28, 2010.

(51) Int. Cl.
*A63H 17/26* (2006.01)
*A63H 13/00* (2006.01)
(Continued)

(52) U.S. Cl.
CPC ..... *A63H 17/262* (2013.01); *A63H 13/00* (2013.01); *A63H 17/004* (2013.01); *A63H 33/003* (2013.01)

(58) Field of Classification Search
CPC .. A63H 17/004; A63H 17/262; A63H 17/266
USPC ..... 446/448, 465, 466, 469
See application file for complete search history.

(56) References Cited

U.S. PATENT DOCUMENTS 3,147,566 A * 9/1964 Ong ..... A63H 3/18 446/359
3,721,042 A 3/1973 Marason, Jr.
(Continued)

FOREIGN PATENT DOCUMENTS

CN 2568263 8/2003
CN 2726681 9/2005
(Continued)

OTHER PUBLICATIONS

Notification of Transmittal of the International Search Report and the Written Opinion of the International Searching Authority or the Declaration, and the International Search Report mailed Feb. 9, 2012 for International Application No. PCT/US2011/038343 and filed May 27, 2011. All references cited are incorporated herein.
(Continued)

*Primary Examiner* — Melba Bumgarner
*Assistant Examiner* — Joseph B Baldori
(74) *Attorney, Agent, or Firm* — Edell, Shapiro & Finnan, LLC

(57) ABSTRACT

A toy vehicle is provided. The toy vehicle having: a vehicle chassis defining a first interior region; a leg movably secured to the vehicle chassis for movement from a first position to a second position, wherein the leg and a wheel rotatably secured to the leg is extended away from the chassis when the leg is moved to the second position; a spring for providing a biasing force to retain the leg into the first position; and an actuation unit received within the first interior region of the chassis and operably coupled to the movable leg member and a body portion movably secured to the chassis, the actuation unit being configured to overcome the biasing force of the spring and move the leg to the second position when the body portion is moved with respect to the chassis.

11 Claims, 22 Drawing Sheets

(51) Int. Cl.
*A63H 17/00* (2006.01)
*A63H 33/00* (2006.01)

(56) References Cited

U.S. PATENT DOCUMENTS

| | | | | |
|---|---|---|---|---|
| 3,856,304 | A | | 12/1974 | Matsumoto et al. |
| 3,859,752 | A | | 1/1975 | Morrison et al. |
| 3,927,883 | A | | 12/1975 | Bosley et al. |
| 3,947,994 | A | | 4/1976 | Meyer et al. |
| 3,955,311 | A | | 5/1976 | Lyons et al. |
| 3,986,295 | A | | 10/1976 | Keller |
| 4,003,158 | A | | 1/1977 | Wolf et al. |
| 4,186,518 | A | | 2/1980 | Luke |
| 4,248,006 | A | | 2/1981 | Jones et al. |
| 4,319,751 | A | | 3/1982 | Kurushima et al. |
| 4,367,875 | A | | 1/1983 | Barlow et al. |
| 4,457,097 | A | | 7/1984 | Miller et al. |
| 4,556,397 | A | * | 12/1985 | Arad et al. ..... 446/436 |
| 4,568,307 | A | | 2/1986 | Gabler et al. |
| 4,573,942 | A | | 3/1986 | Ogawa |
| 4,573,944 | A | | 3/1986 | Crow et al. |
| 4,579,542 | A | | 4/1986 | Mayer et al. |
| 4,597,744 | A | * | 7/1986 | Rehkemper et al. ..... 446/278 |
| 4,601,671 | A | | 7/1986 | DeMars |
| 4,609,195 | A | | 9/1986 | Ham |
| 4,655,725 | A | | 4/1987 | Torres |
| 4,655,727 | A | | 4/1987 | Swisher et al. |
| 4,666,420 | A | | 5/1987 | Nagano |
| 4,717,367 | A | | 1/1988 | Stubenfoil et al. |
| 4,738,649 | A | | 4/1988 | Delli Bovi et al. |
| 4,772,242 | A | | 9/1988 | McKay et al. |
| 4,822,316 | A | | 4/1989 | Shaffer et al. |
| 4,850,929 | A | | 7/1989 | Genevey |
| 4,985,008 | A | | 1/1991 | Price |
| 5,046,987 | A | | 9/1991 | Djordjevic |
| 5,087,219 | A | | 2/1992 | Price |
| 5,102,367 | A | | 4/1992 | Mullaney et al. |
| 5,228,880 | A | | 7/1993 | Meyer et al. |
| 5,259,808 | A | | 11/1993 | Garr |
| 5,267,888 | A | | 12/1993 | Hippely et al. |
| 5,292,275 | A | | 3/1994 | Swisher et al. |
| 5,322,469 | A | | 6/1994 | Tilbor |
| 5,334,078 | A | | 8/1994 | Hippely et al. |
| 5,378,188 | A | | 1/1995 | Clark |
| 5,458,523 | A | | 10/1995 | Aoki et al. |
| 5,487,692 | A | | 1/1996 | Mowrer et al. |
| 5,525,090 | A | | 6/1996 | Halford et al. |
| 5,580,296 | A | | 12/1996 | Chow |
| 5,609,510 | A | | 3/1997 | Stubenfoil et al. |
| 5,618,219 | A | | 4/1997 | Simone et al. |
| 5,626,506 | A | | 5/1997 | Halford et al. |
| 5,722,872 | A | | 3/1998 | Simmons et al. |
| 5,860,846 | A | | 1/1999 | Uetake |
| 5,951,363 | A | | 9/1999 | Uetake |
| 6,012,962 | A | | 1/2000 | Arriola |
| 6,015,330 | A | | 1/2000 | Simmons et al. |
| 6,036,575 | A | | 3/2000 | Rehkemper et al. |
| 6,176,759 | B1 | | 1/2001 | Trageser |
| 6,224,456 | B1 | | 5/2001 | Wittenberg |
| 6,280,286 | B1 | | 8/2001 | Andrews |
| 6,296,543 | B1 | | 10/2001 | Andrews |
| 6,350,171 | B1 | | 2/2002 | Hippely et al. |
| 6,383,054 | B1 | | 5/2002 | Rauch |
| 6,394,876 | B1 | | 5/2002 | Ishimoto |
| 6,540,583 | B1 | | 4/2003 | Hoeting et al. |
| 6,565,412 | B1 | | 5/2003 | Thrasher |
| 6,568,984 | B1 | | 5/2003 | Applewhite |
| 6,589,098 | B2 | | 7/2003 | Lee et al. |
| 6,620,023 | B2 | | 9/2003 | Yeung |
| 6,752,684 | B1 | | 6/2004 | Lee |
| 6,758,719 | B1 | * | 7/2004 | Nava ..... 446/466 |
| 6,764,376 | B2 | | 7/2004 | Agostini et al. |
| 6,767,272 | B2 | | 7/2004 | Santarsiero |
| 6,793,555 | B1 | | 9/2004 | Tilbor et al. |
| 6,926,581 | B2 | | 8/2005 | Lynders et al. |
| 6,939,197 | B1 | | 9/2005 | Hoeting |
| 7,033,241 | B2 | | 4/2006 | Lee et al. |
| 7,234,992 | B2 | | 6/2007 | Weiss et al. |
| 7,387,558 | B2 | | 6/2008 | Swisher et al. |
| 7,475,881 | B2 | | 1/2009 | Blagg et al. |
| 7,722,430 | B2 | * | 5/2010 | Hippely ..... 446/470 |
| 7,749,046 | B2 | | 7/2010 | Miva et al. |
| 7,927,174 | B2 | | 4/2011 | Kim et al. |
| 2004/0198165 | A1 | * | 10/2004 | Lee et al. ..... 446/427 |
| 2006/0135036 | A1 | | 6/2006 | Miva et al. |
| 2006/0270313 | A1 | | 11/2006 | Campbell |
| 2006/0292965 | A1 | | 12/2006 | Strauss |
| 2007/0178804 | A1 | | 8/2007 | Hippely et al. |
| 2007/0259590 | A1 | * | 11/2007 | Hippely ..... 446/6 |
| 2007/0259591 | A1 | | 11/2007 | Dunham |
| 2007/0259599 | A1 | * | 11/2007 | Swisher et al. ..... 446/427 |
| 2007/0259603 | A1 | | 11/2007 | Hippely |
| 2008/0070475 | A1 | | 3/2008 | Hippely |
| 2008/0220692 | A1 | | 9/2008 | Torres et al. |
| 2010/0068969 | A1 | | 3/2010 | Kim et al. |
| 2012/0322341 | A1 | * | 12/2012 | Benedict et al. ..... 446/437 |
| 2014/0248821 | A1 | * | 9/2014 | Hippely et al. ..... 446/465 |

FOREIGN PATENT DOCUMENTS

| | | | |
|---|---|---|---|
| CN | 1788821 | B | 8/2010 |
| EP | 1810735 | A1 | 7/2007 |
| WO | 0156674 | A1 | 8/2001 |
| WO | 2004082792 | A1 | 9/2004 |
| WO | 2010019894 | A2 | 2/2010 |

OTHER PUBLICATIONS

Written Opinion of the International Searching Authority mailed Feb. 9, 2012 for International application No. PCT/U52011/038343 with an International filing date of May 27, 2011.

International Preliminary Report on Patentability; PCT/US2011/038343; dated Dec. 4, 2012.

European Search Report of the International Application No. PCT/US2011038343 mailed Feb. 18, 2014.

Chinese Office Action for Patent Application No. 201180034914.4.

CN1788821 Machine Translation.

CN2726681 Machine Translation.

CN2568263 Machine Translation.

* cited by examiner

TOY VEHICLE

The present application claims the benefit of Provisional Application, Ser. No. 61/349,634, filed May 28, 2010, the contents each of which are incorporated herein by reference thereto.

BACKGROUND

The present disclosure relates to toy vehicles and more particularly to mechanically actuated features of a toy vehicle that provides for enhanced play or options.

Toy vehicles are configured in a variety of styles to allow for enhanced play. Self-propelled toy vehicles have been provided that move without or with reduced inaction from the user. Other toy vehicles are known as transformable toy vehicles. A transformable toy vehicle converts from a first configuration, such as a sports car or truck for example, into a second configuration, such as a helicopter or plane for example. Vehicles with more than one mode or configuration that provide additional functionality are desirable since they enhance the creative play and skills developed by the user.

Toy vehicles having some form of extra functionality are popular among children. Accordingly, it is desirable to provide vehicles with functional features to allow simulation of actions by the toy.

SUMMARY OF THE INVENTION

A toy vehicle is provided. The toy vehicle having a vehicle chassis defining a first interior region. A body portion is movably secured to the chassis. A leg member is movably secured to the vehicle chassis for movement from a first position to a second position, wherein the leg member and a wheel rotatably secured to the leg is moved relative to the chassis when the leg member is moved between the first position and the second position the second position. A spring is arranged for providing a biasing force to retain the leg toward the first position. An actuation unit is received within the first interior region of the chassis and operably coupled to the movable leg member, the actuation unit being configured to overcome the biasing force of the spring and move the leg member to the second position when the body portion is moved relative to the chassis.

In another exemplary embodiment, a toy vehicle is provided the toy vehicle having a vehicle chassis having a pair of wheels each independently secured to the chassis via a leg movably secured to the vehicle chassis for movement between a first position and a second position, wherein the leg and a wheel rotatably secured to the leg is extended away from the chassis when the leg is moved to the second position. A spring is arranged for providing a biasing force to retain the leg into the first position. A body portion is moveably mounted to the chassis wherein the body portion can be moved towards the chassis in a plurality of directions; and an actuation unit received within an interior region of the chassis and operably coupled to each leg member, the actuation unit being configured to selectively extend either or both of the pair of wheels from the toy vehicle by moving the leg members to the second position from the first position, wherein movement of the leg members from the first position to the second position is dependant upon one of the plurality of directions the body portion moves in as it is moved towards the chassis.

In still another exemplary embodiment, a method for selectively moving a pair of wheels of a toy vehicle away from a chassis of the toy vehicle is provided. The method includes the steps of independently securing the pair of wheels to the chassis of the toy vehicle with a leg movably secured to the vehicle chassis for movement between a first position and a second position, wherein the leg and one of the pair of wheels rotatably secured to the leg is extended away from the chassis when the leg is moved to the second position. Each leg is biased into the first position. A body portion is movably mounted to the chassis, wherein the body portion can be moved towards the chassis in a plurality of directions. The body portion is coupled to each of the pair of wheels with an actuation unit received within an interior region of the chassis, the actuation unit being operably coupled to each leg member and being configured to selectively extend either or both of the pair of wheels from the toy vehicle by moving the leg members to the second position from the first position, wherein movement of the leg members from the first position to the second position is dependant upon one of the plurality of directions the body portion moves in as it is moved towards the chassis.

BRIEF DESCRIPTION OF THE DRAWINGS

Other features, advantages and details appear, by way of example only, in the following description of embodiments, the description referring to the drawings in which.

DETAILED DESCRIPTION

Figure 1A:
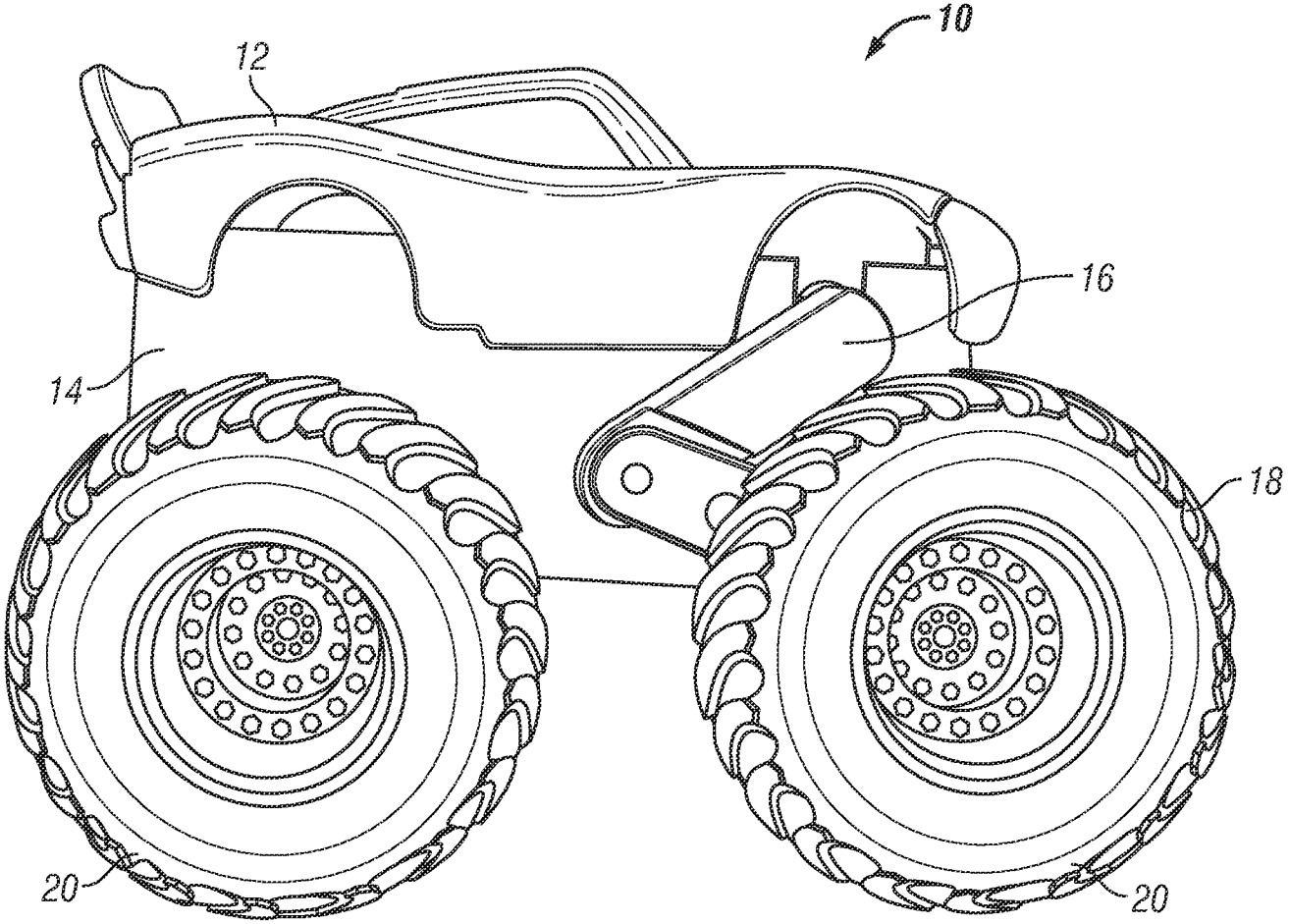
FIG. 1A is a side view of a toy vehicle in accordance with an exemplary embodiment.
Figure 1B:
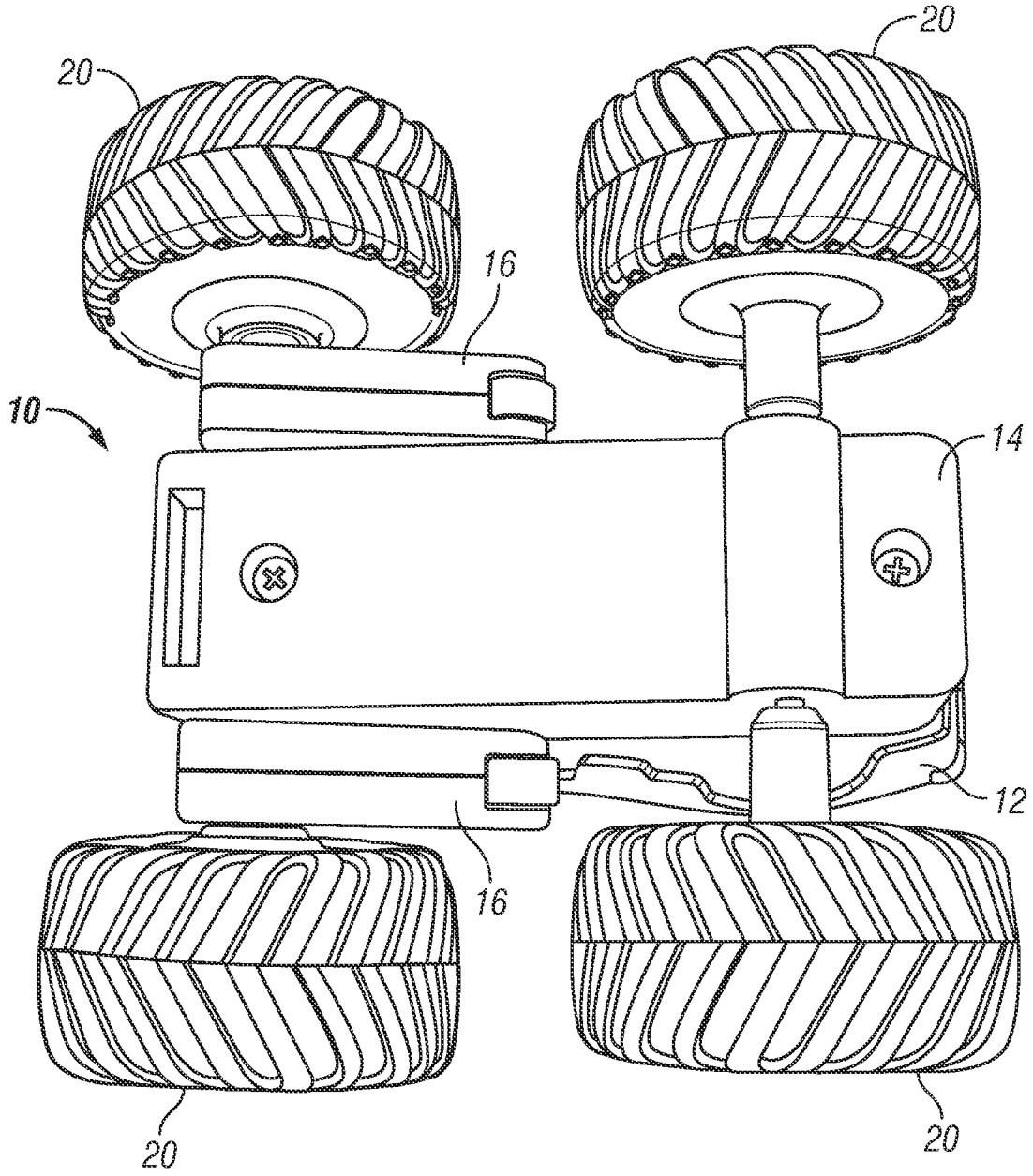
FIG. 1B is a bottom view of the toy vehicle of FIG. 1A
Figure 2A:
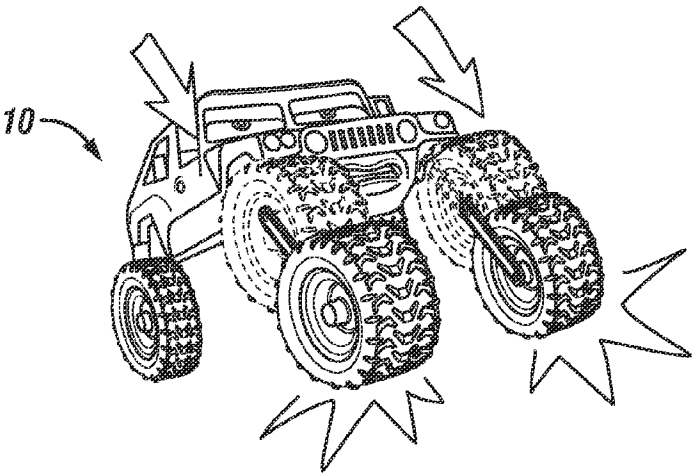
FIGS. 2A-2D are side perspective views illustrating movement of a feature of the toy vehicle in accordance with various embodiments.
Figure 2B:
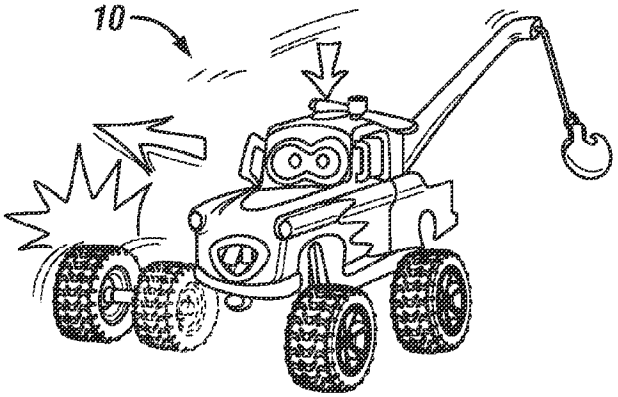
Figure 2C:
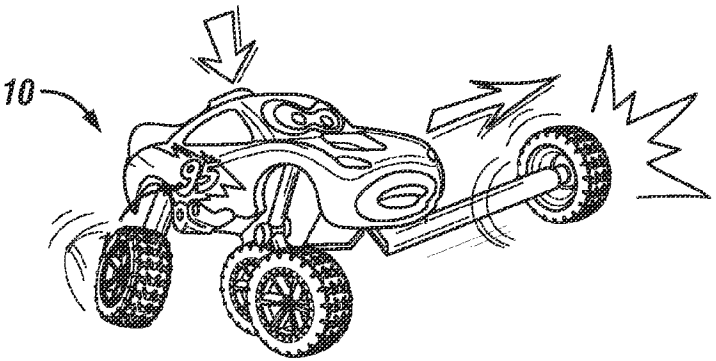
Figure 2D:
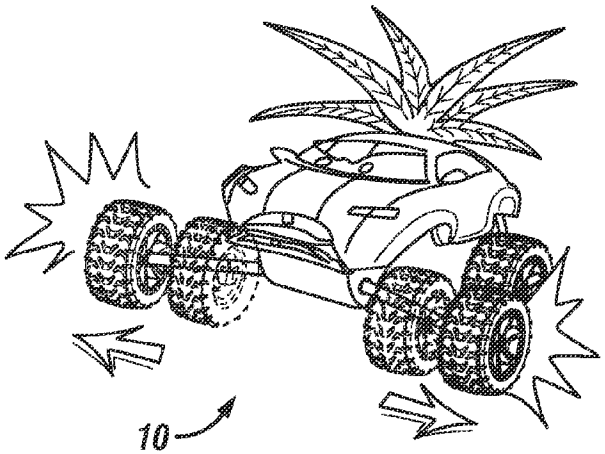

The following description is merely exemplary in nature and is not intended to limit the present disclosure, application, or uses. It should be understood that throughout the drawings, corresponding reference numerals indicate like or corresponding parts and features.

Referring to FIGS. 1 through 7 a toy vehicle that includes one or more functional features is described and shown.

Referring now to the FIGS., a toy vehicle 10 is provided in accordance with various embodiments. The toy 10 vehicle includes, but is not limited to, a body 12, and a chassis 14. In various embodiments, the body 12 is a replication of a vehicle, such as, a car, a truck, a bus, etc. As can be appreciated, the body 12 may also include vehicle components such as, doors, a windshield or windows, a hood, headlights, a bumper, etc. The body 12 couples to the chassis 14. A plurality of leg members 16 are pivotally mounted to the chassis 14 for movement between a first position and a second position wherein the leg members 16 extend outwardly from the chassis 14 in the second position and the leg members 16 are in an un-extended or retracted position in the first position. In various embodiments, one or more of the leg members 16 are movable with respect to the chassis 14 and are spring biased toward the first position. A plurality of wheels 18 are rotatably mounted to the vehicle 10 and each leg member 16 has a wheel 18 rotatably secured thereto. In one embodiment, the wheels 18 include tires 20 that are configured to resemble large off-road type vehicle tires.

The chassis 14 defines an interior region 22 (as shown in FIGS. 3A, 4C, 5, and 6A). The interior region 22 houses an actuation unit 24 configured to move the one or more leg members 16 from the first position to the second position. In one embodiment, the movement of the leg members 16 to the second position can simulate a fighting move (i.e., punching or kicking) of the toy vehicle 10. For example, as shown in FIGS. 2A-2D the movement can be outwardly extending a forward leg member in a side direction, outwardly extending a forward leg member in a front direction, outwardly extending a rear leg member in a side direction, or outwardly extending a rear leg member in a rear direction.

Figure 3A:
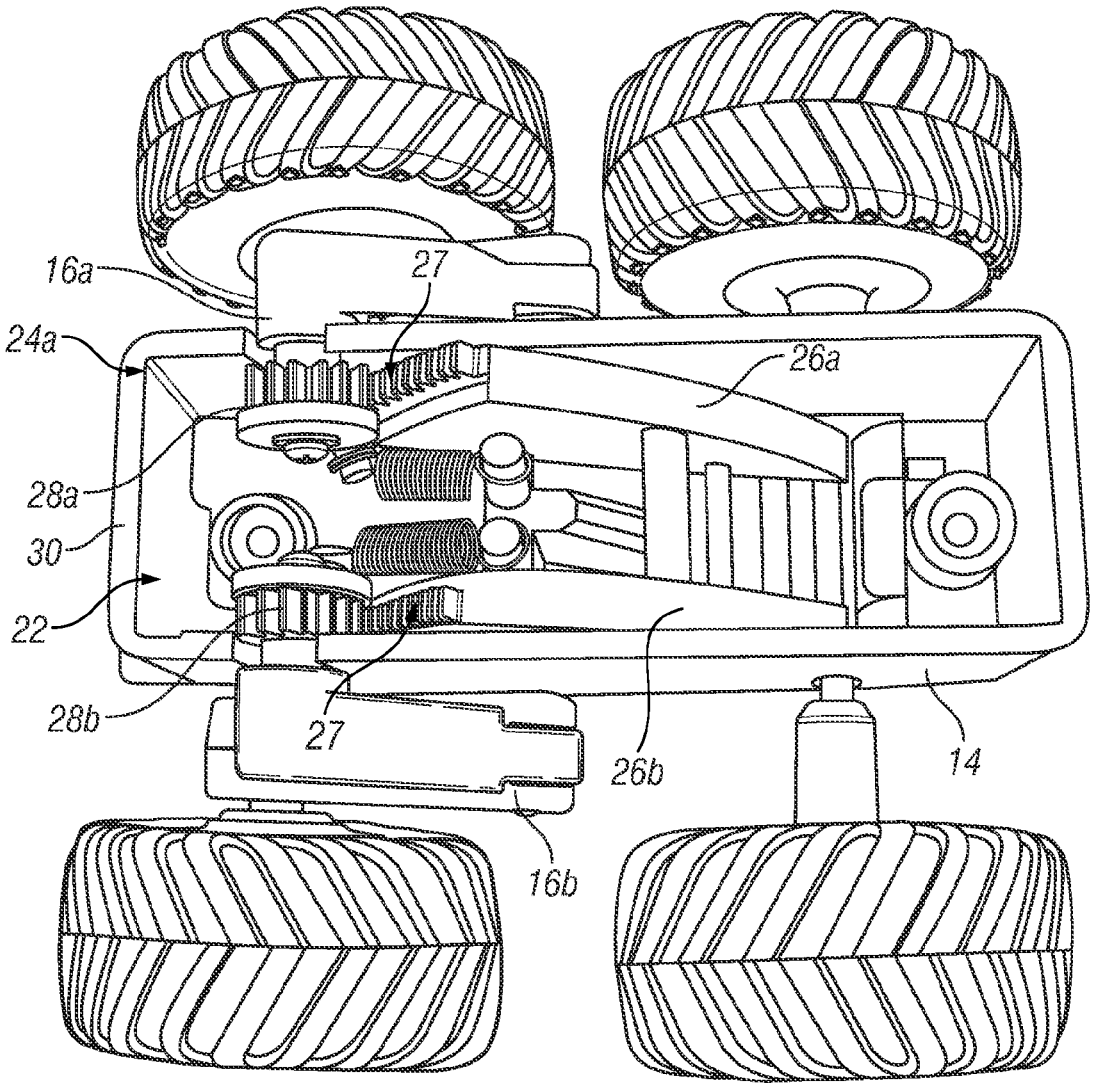
FIGS. 3A-3C are views of an actuation unit that actuates a vehicle feature in accordance with an exemplary embodiment.
Figure 3B:
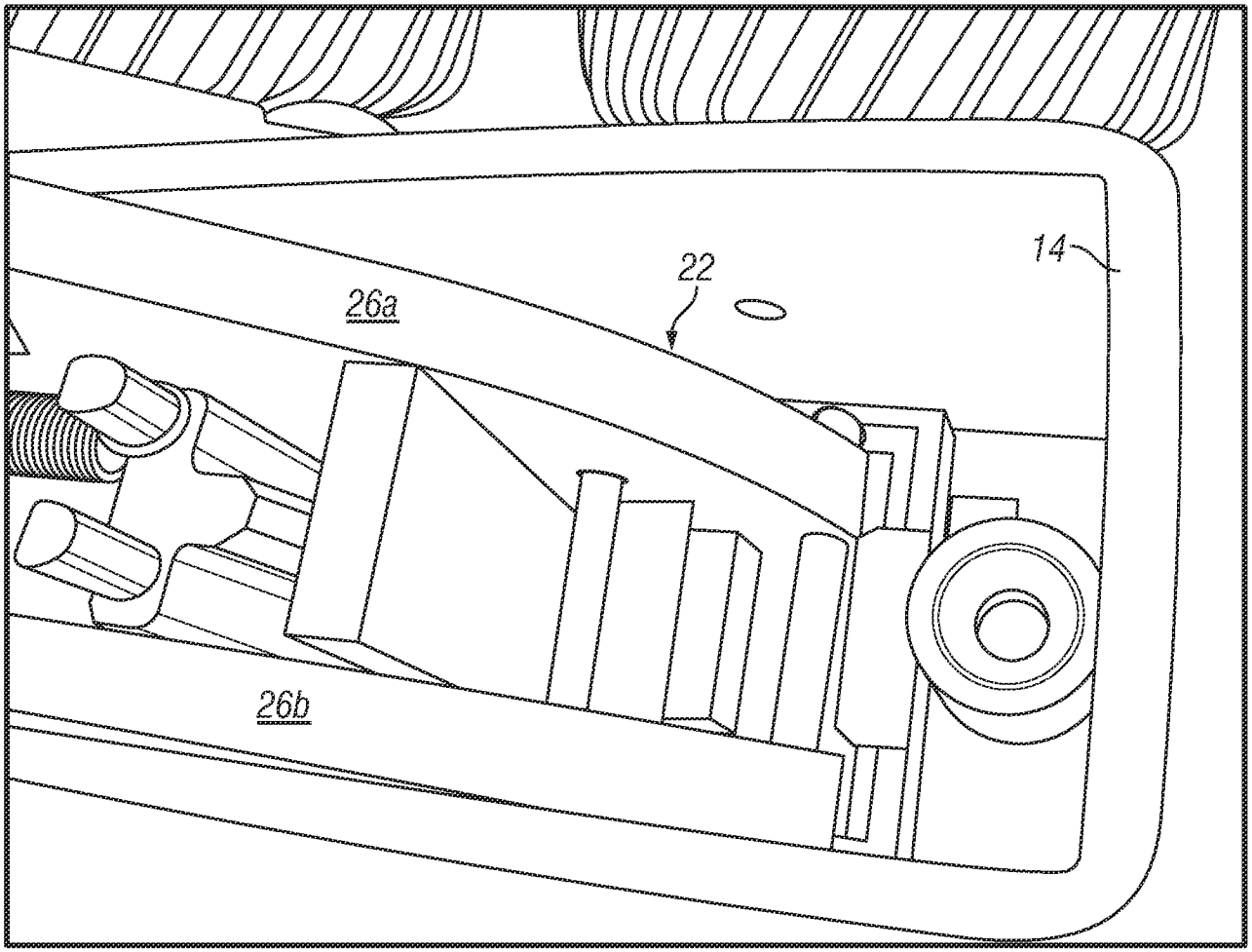

With reference now to FIGS. 3A-3B, and in one embodiment, a first actuation unit 24*a* can include a spring biased gear system. For example, the actuation unit 24*a* can include an actuating member 26 or members 26*a* and 26*b* pivotally coupled to the chassis 14 within the interior region 22, the actuating member 26 or members 26*a* or 26*b* each have a rack or toothed portion 27 or any other equivalent surface configured to engage a gear 28 or gears 28*a*, 28*b* rotatably mounted to the chassis 14 to couple to the actuating member 26 to the gear 28 or gears 28*a*, 28*b*.

In one embodiment, each gear 28*a* and 28*b* is also coupled to a respective leg member 16*a*, 16*b* such that rotation of the gears 28*a* and 28*b* by movement of actuating members 26*a* and 26*b* moves the leg member 16*a* and 16*b* outwardly. Furthermore each gear 28*a* and 28*b* also couples to a spring such that rotation of the gear in a first direction against the biasing force of the spring will cause the gear and the leg member to return to a first or un-actuated position after an applied force is removed.

For example, a first movable leg member (e.g., a front right movable leg member 16*a*), is coupled to the gear 28*a* and the gear 28*a* is coupled to an actuating member 26*a* while a second gear 28*b* is coupled to a second movable leg member 16*b*, (e.g., a front left movable leg member) and the second gear is coupled to a second actuation member 26*b*. As can further be appreciated, the actuation unit 24*a* can similarly include actuating members and gears that couple to rear mounted movable leg members (embodiment not shown).

In any of the embodiments, the body 12 can be mounted to the chassis such that the body is freely floating with respect to the chassis 14 and the body 12 may be manipulated in an essentially vertical downward direction with respect to the chassis 14 or an angled downward direction with respect to the chassis such that depending on the downward movement of the body 12 with respect to the chassis 14 either one or both of the actuation members 26*a*, 26*b* are manipulated to provide the effect of extending either the left front wheel or the right front wheel or both wheels simultaneously. In one non-limiting configuration and in order to provide the angled downward movement (i.e. toward the play surface) of the body, the body is mounted to the chassis so it may be pivoted left to right and/or right to left prior to it being depressed downwardly. In one embodiment, the toy vehicle 10 is lifted such that the forward wheels are lifted from a surface (so they can move outwardly away from the chassis 14) while the rear wheels remain substantially on the surface and movement of the body 12 downwardly to the left, right or center with respect to the chassis 14 will cause the left and right leg members 16*a*, 16*b* to extend from the toy vehicle 10, which as discussed above may resemble a simulated fighting move such as punching or kicking. It is, of course, understood that in an alternative embodiment, the rear wheels may be extended from the vehicle in a similar fashion.

Accordingly, the body 12 (FIG. 1A) is configured such that when the body 12 or a portion of the body 12 is depressed toward the chassis 14 in any one of the various directions mentioned above or equivalents thereof, one or more contact points of the body 12 actuate the one or both of the actuating member(s) 26*a*, 26*b* and as discussed above the actuation of the actuating member(s) 26*a*, 26*b* induces the gear(s) 28*a*, 28*b* to rotate. The rotation of the gear(s) 28*a*, 28*b* further induces the movable leg member(s) 16*a*, 16*b* to extend. In one exemplary embodiment, the movable leg members further comprise an upper leg portion and lower leg portion wherein the upper leg portion is secured to the gear at one end and pivotally mounted to the lower leg portion at the other end and the wheel is rotatably secured to the lower leg portion.

As discussed above, each gear 28*a*, 28*b* and accordingly each leg member 16*a*, 16*b* is spring biased toward the first position such that when the body 12 or portion of the body 12 (FIG. 1A) is released or allowed to move upwardly from the chassis 14, the actuating member(s) 26*a*, 26*b* and the gears 28*a*, 28*b* are moved in a reverse or opposite direction which causes the movable leg member(s) 16*a*, 16*b* to retract to the first position. In one embodiment, the body 12 may be spring biased upwardly and/or the springs coupled to the gears 28*a*, 28*b* move the body upwardly.

In various alternative embodiments, a portion of the body 12 (FIG. 1A) can be configured to include one or more depressible buttons that, when depressed, actuate or depress the actuating member(s) 26*a*, 26*b* such that the leg members 16*a*, 16*b* extend from the chassis 14.

Figure 3C:
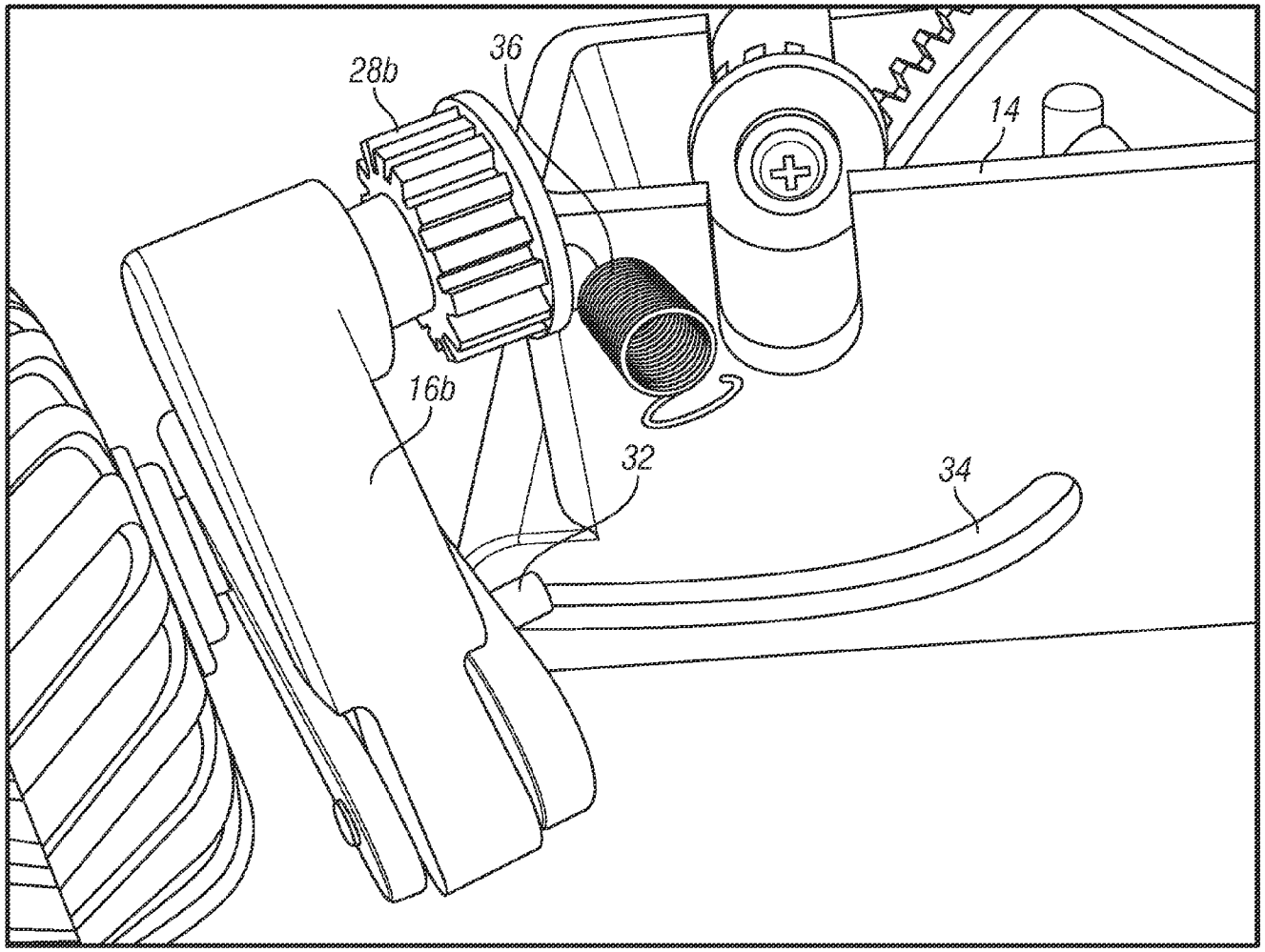
Figure 4A:
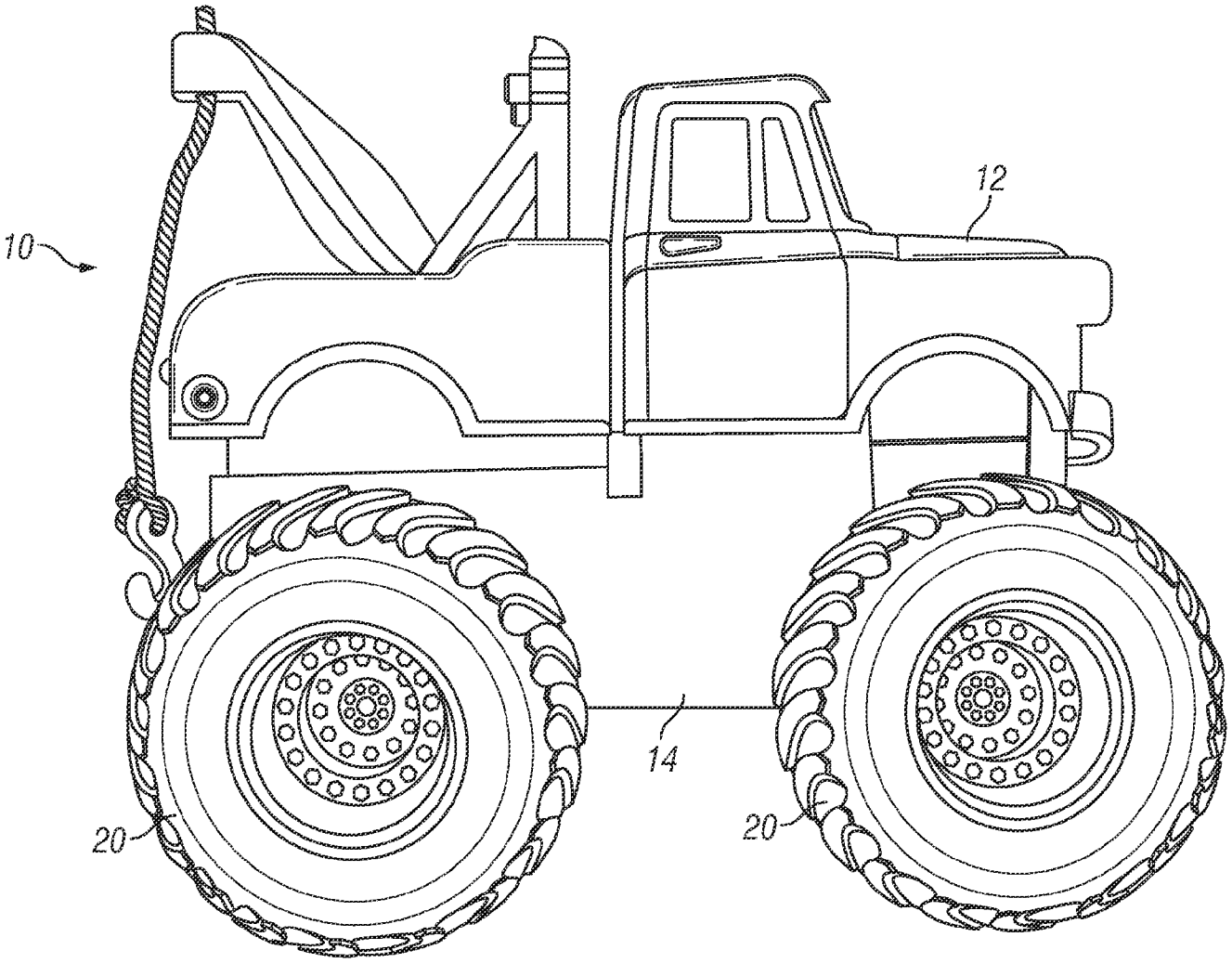
FIGS. 4A-4F are views of another actuation unit that actuates a vehicle feature in accordance with another exemplary embodiment.
Figure 4B:
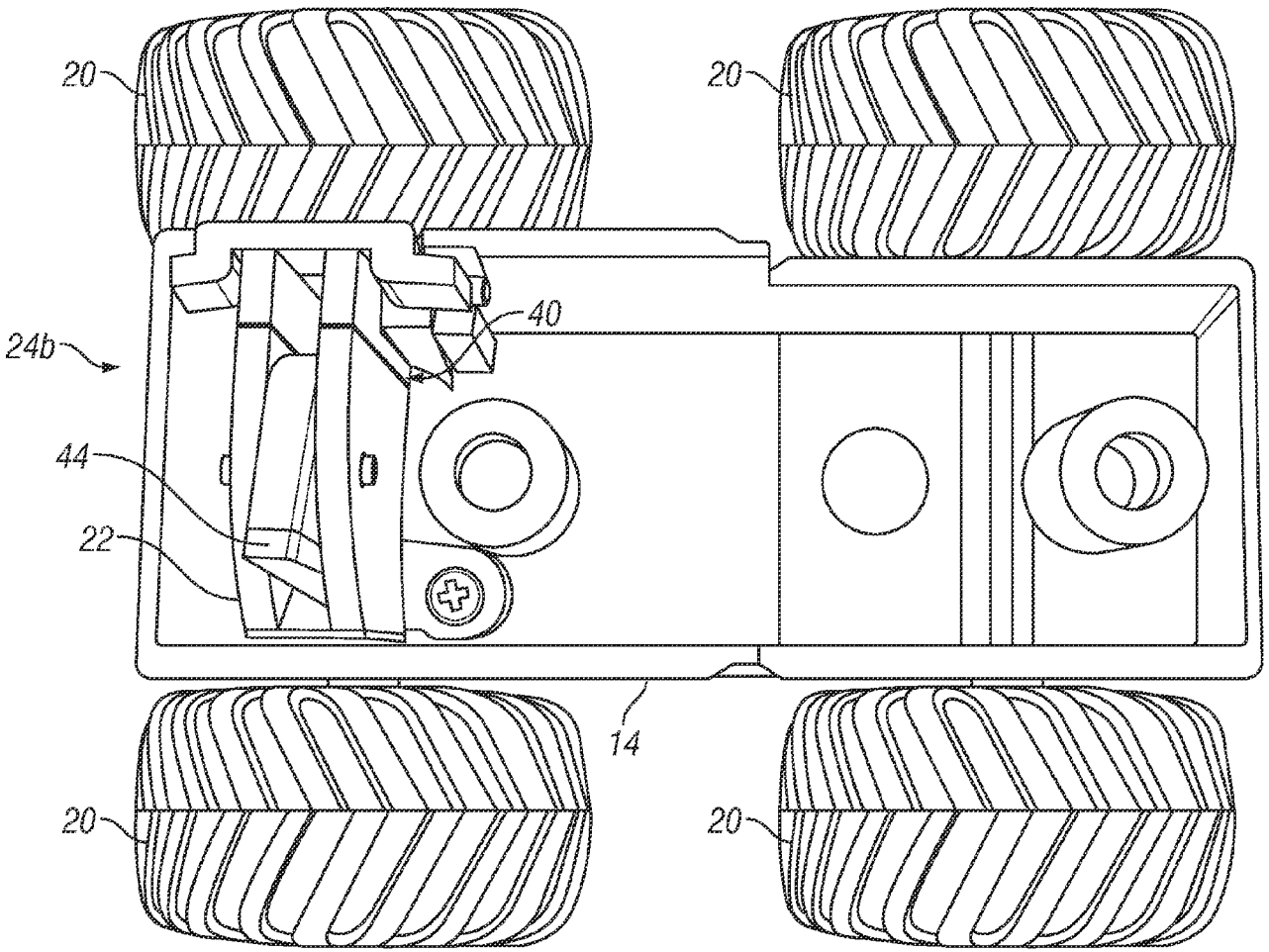
Figure 4C:
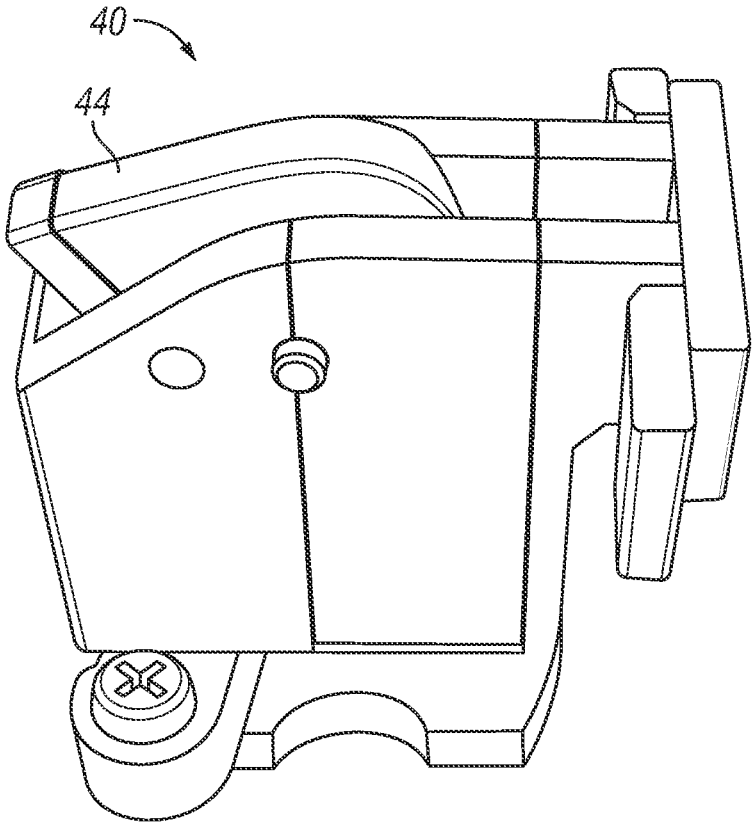
Figure 4D:
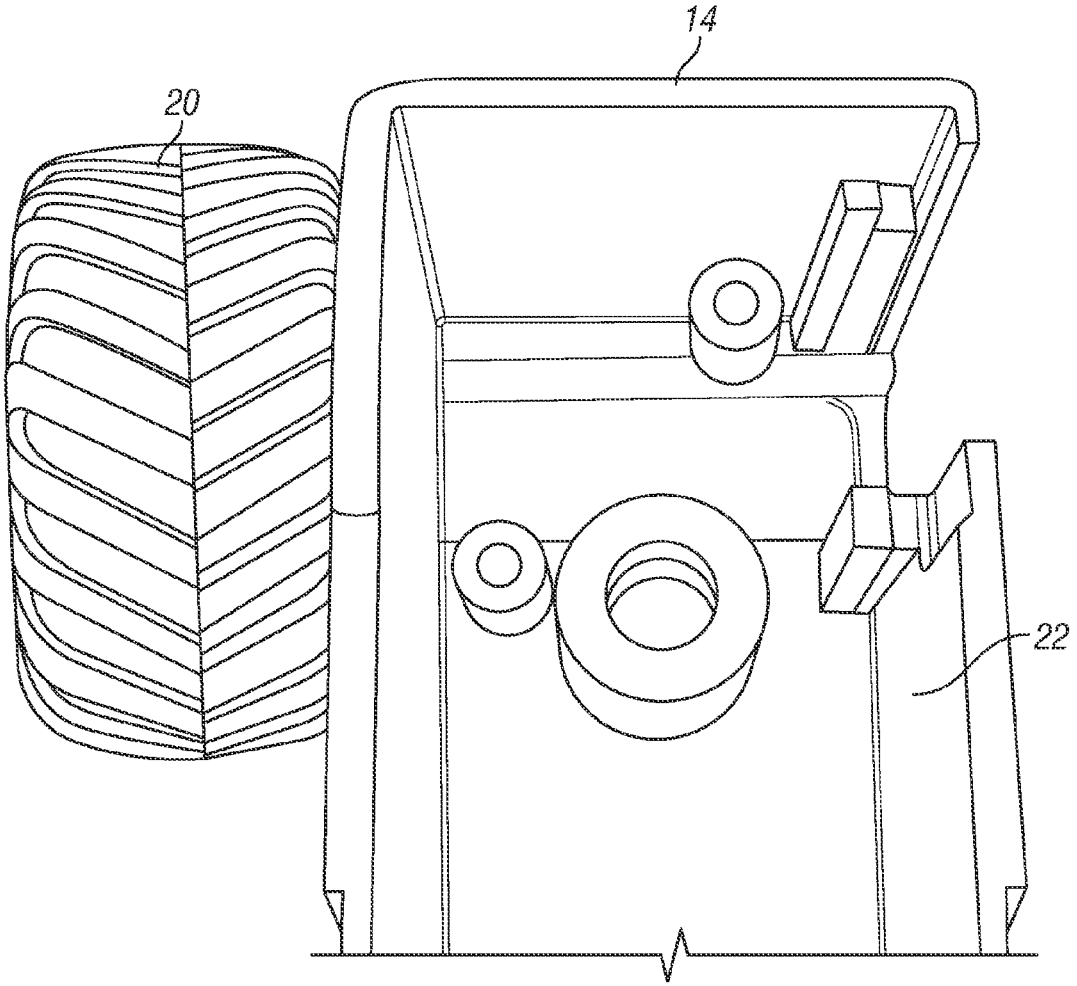
Figure 4E:
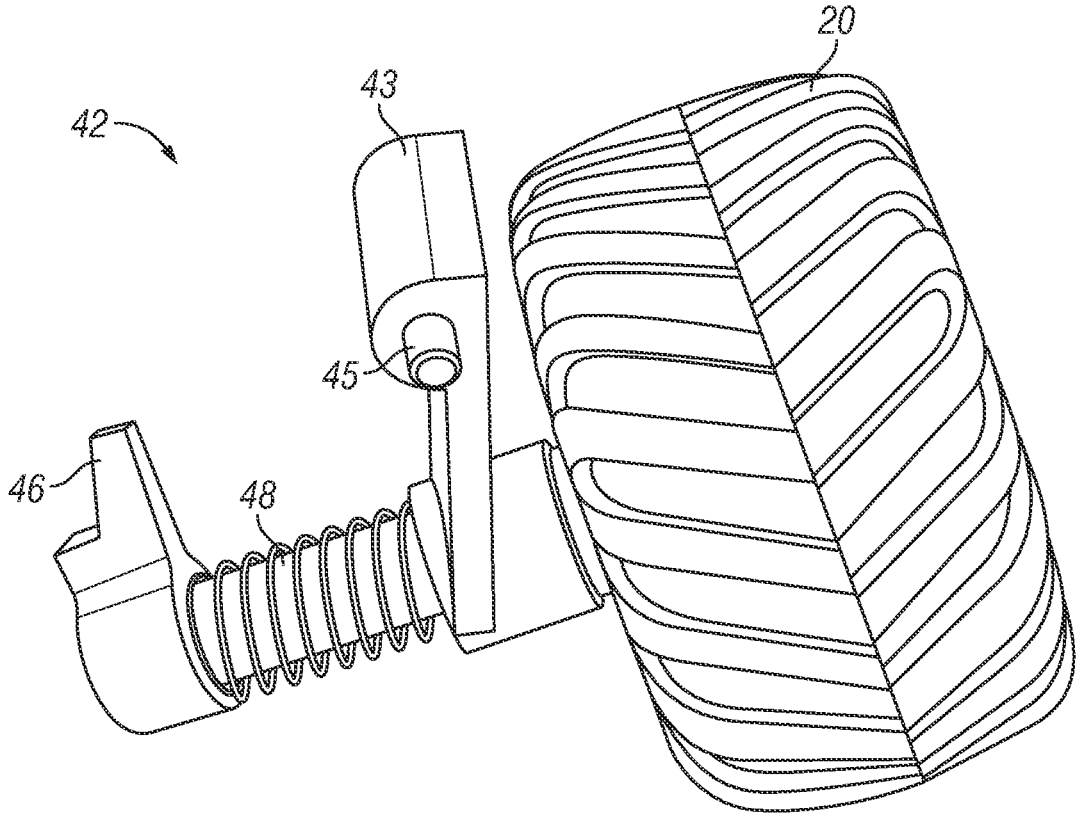
Figure 4F:
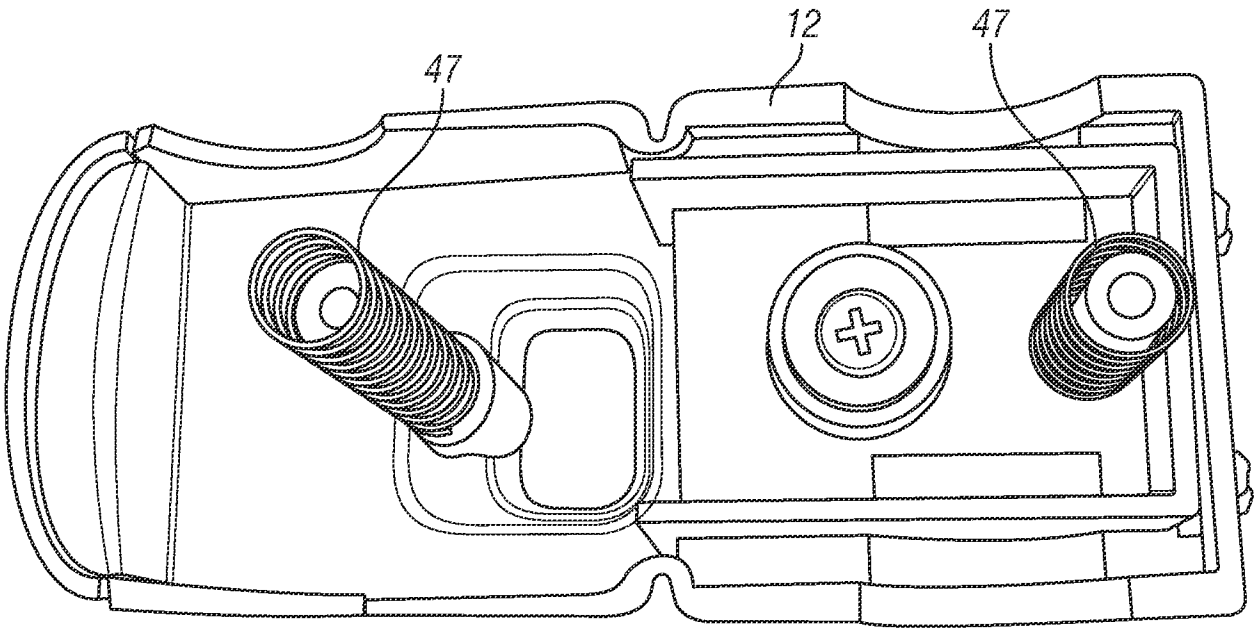
Figure 5A:
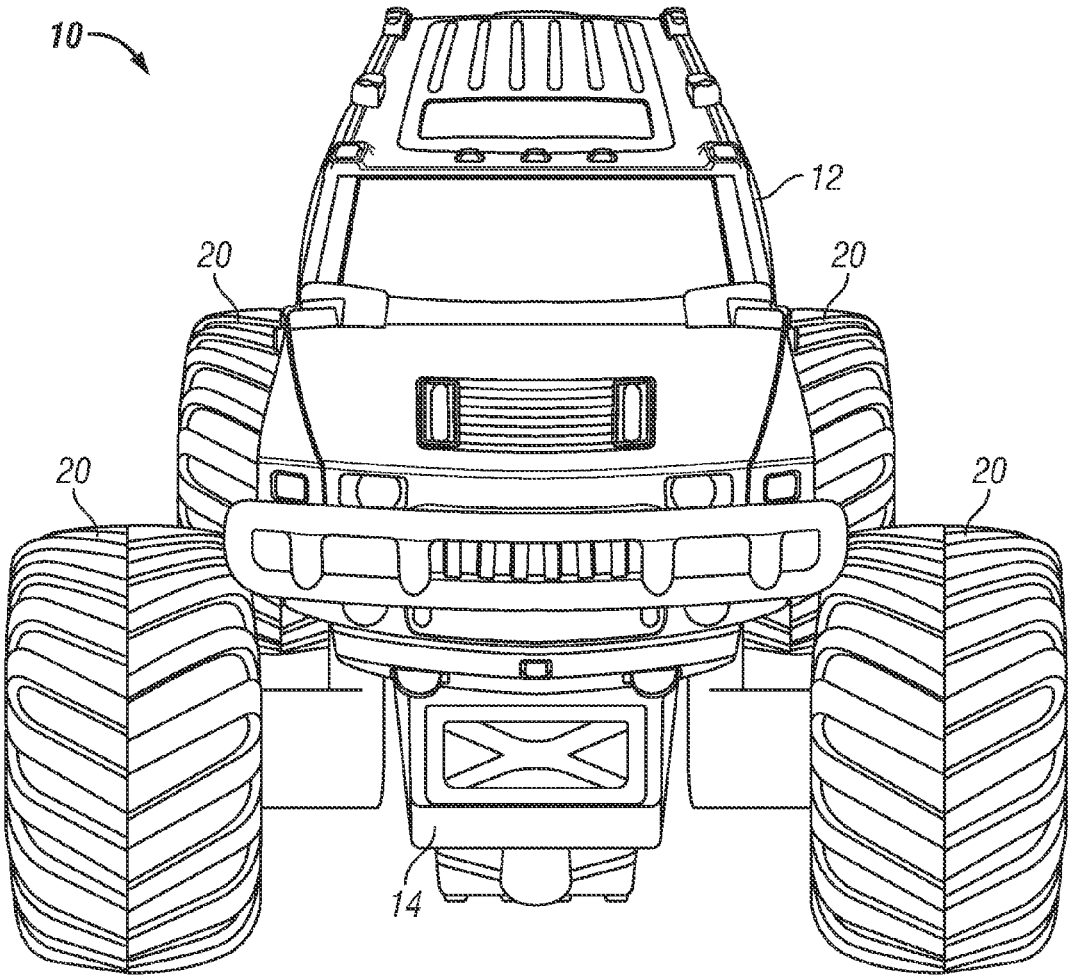
FIGS. 5A-5D are views of still another actuation unit that actuates a vehicle feature in accordance with still another exemplary embodiment.
Figure 5B:
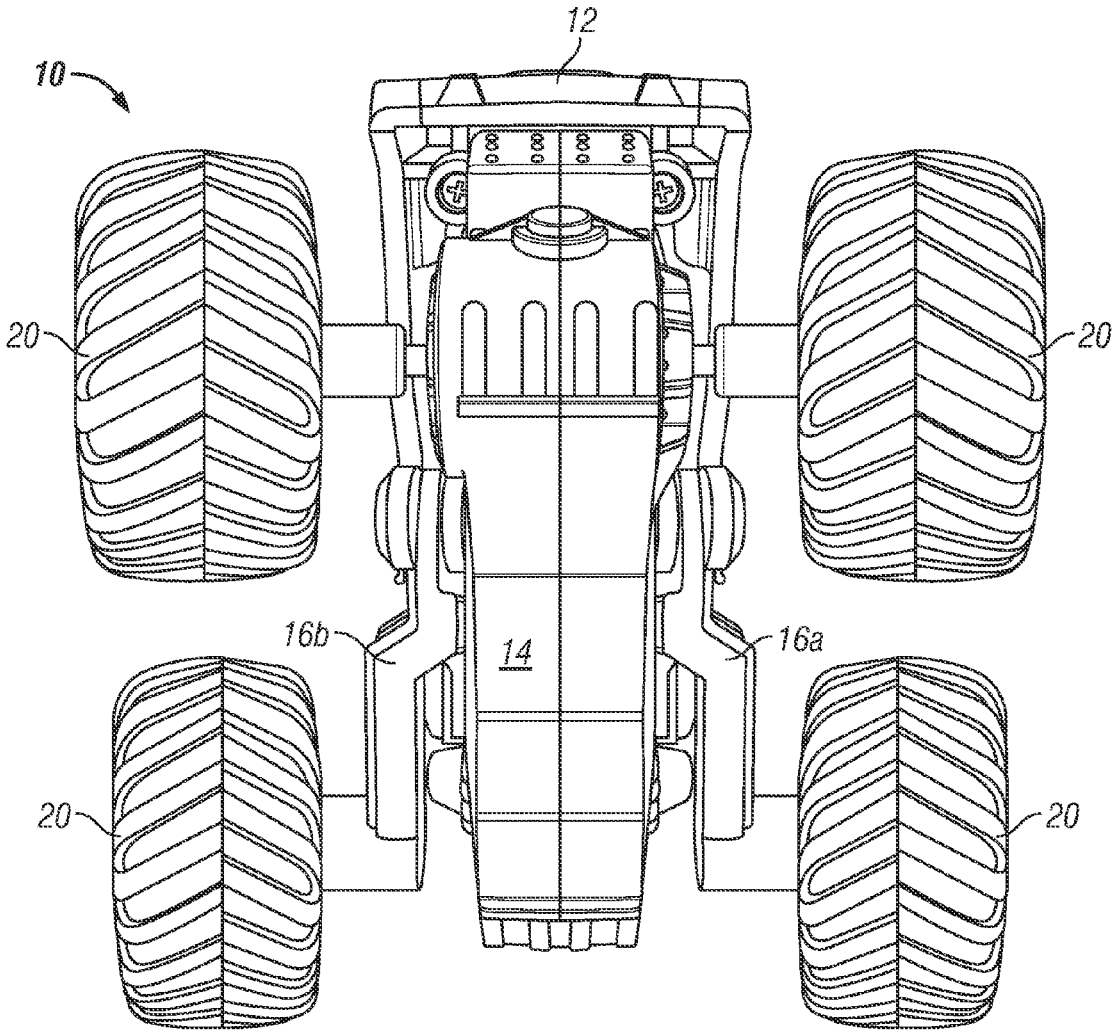
Figure 5C:
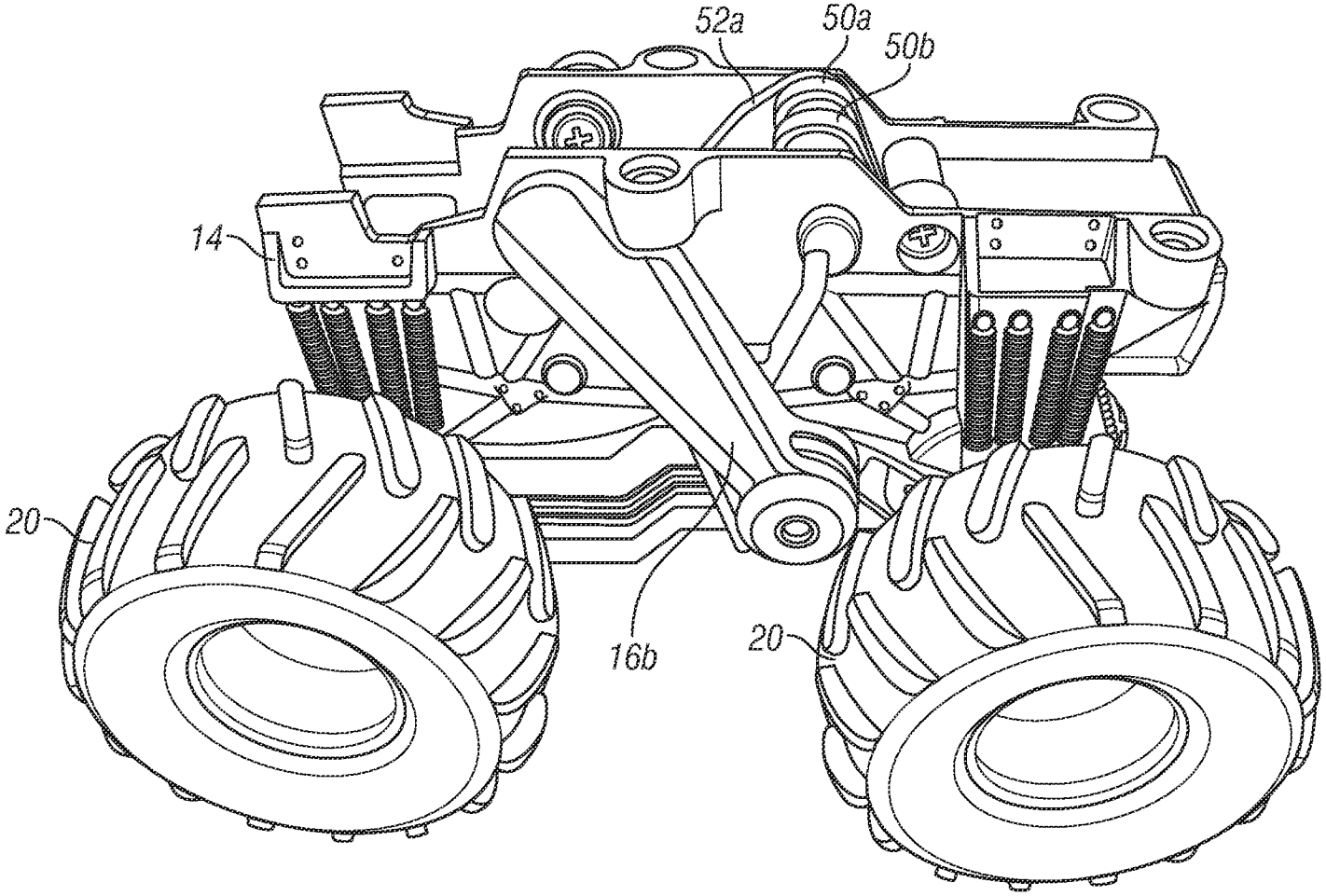
Figure 5D:
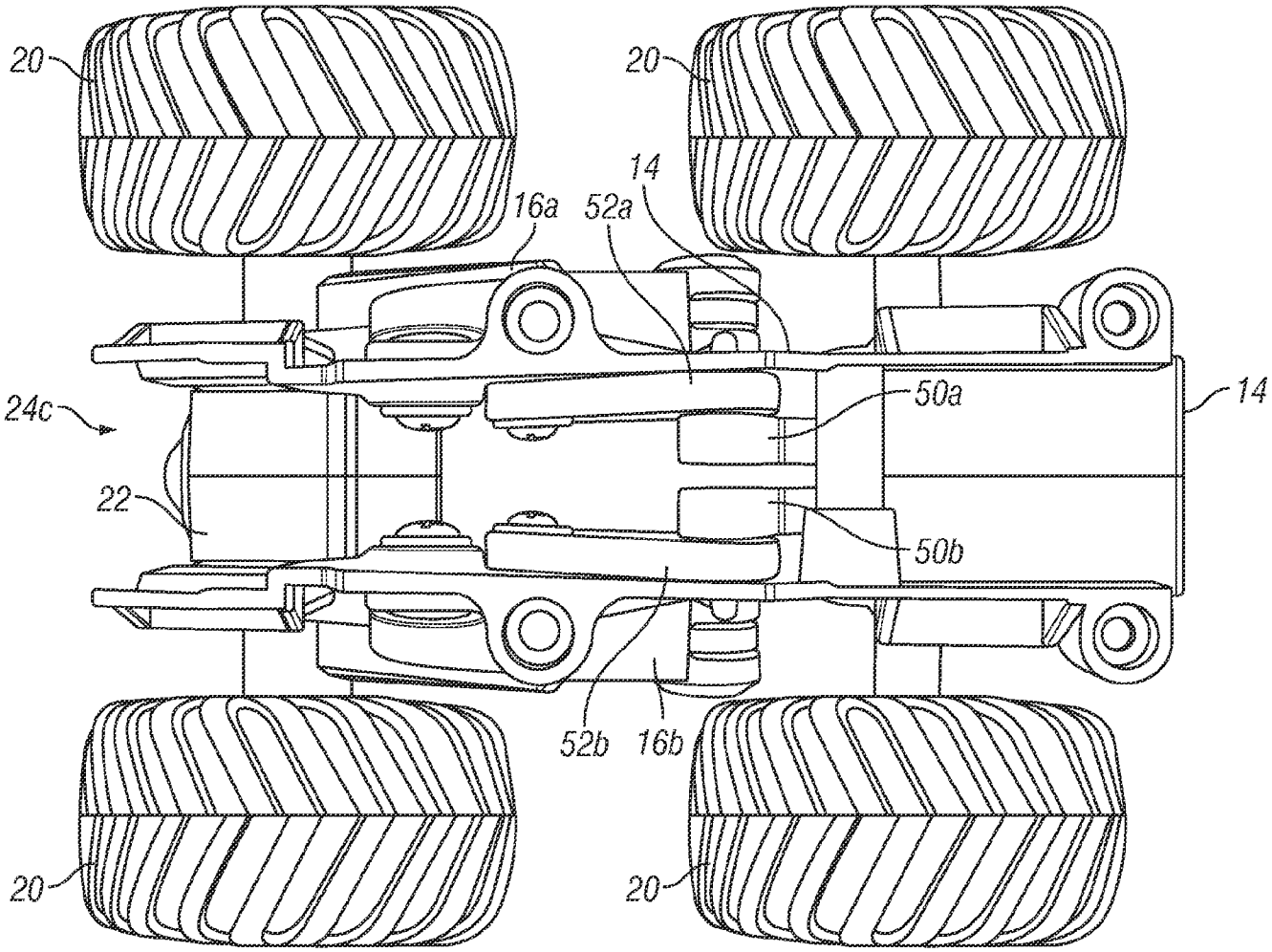

In one exemplary embodiment, the movable leg member(s) 16*a*, 16*b* extend in an outward direction away from the front 30 of the chassis 14. As shown in FIG. 3C and in one non-limiting embodiment, each of the movable leg member(s) 16*a*, 16*b* has a guide or feature 32 that is configured to be received in and slide in an opening 34 of the chassis 14. Accordingly, the guide 32 is configured to assist in regulating the movement of the movable leg member(s) 16*a*, 16*b* along a first axis. As discussed above, springs 36 are coupled to the gears 28*a*, 28*b* and provide a biasing force to the gears 28*a*, 28*b* to return the leg members 16*a*, 16*b* to the first position when the body 12 is moved upwardly away from the chassis 14.

With reference now to FIGS. 4A-4F, an alternative exemplary embodiment is illustrated here actuation unit includes a spring loaded axle system. For example, the actuation unit 24*b* includes an actuating member 40 and an axle portion 42 coupled to the chassis 14 within the interior region 22. The actuating member 40 includes a pivoting arm 44 that is biased into a first position. The pivoting arm is coupled to a tab 46 of the axle portion 42 and the axle portion 42 is biased into a first position by means of a spring 48. The axle portion 42 may include an arm 43 that is pivotally coupled to the chassis 14 by a pin 45.

Accordingly and when a force is applied to the pivoting arm 44 (via movement of the body 12 or any other equivalent device), the pivoting arm 44 is moved and contacts the tab 46 to extend the axle and the movable leg member 16 to a second position or laterally away from the chassis 14 as opposed to forward or rearward movement. When the force is released from the pivoting arm 44, the axle and pivoting arm 44 retracts back to the first position by means of the biasing force of the spring 48. In this embodiment, the movable leg member 16 extends in an outward or lateral direction away from the side of the chassis 14. As can further be appreciated, the actuation unit 24*b* of this embodiment can similarly include an actuating member and an axle portion that correspond to a rear movable leg member.

In various embodiments, the force can be applied to the pivoting arm 44 from a contact of the body 12 such that when the body 12 is depressed in a direction towards the chassis 14, the body 12 applies the force to the pivoting arm 44. Alternatively, an actuation button is provided. In various embodiments, the body 12 may have one or more biasing member, such as springs 47 for example, that allow the body 12 to be movably coupled to the chassis 14.

With reference now to FIG. 5A-5D, another toy vehicle 10 having an another actuation unit 24*c* is illustrated. Here the actuation unit 24*c* includes a linkage system. For example and in one embodiment, the actuation unit 24*c* has at least first and second linking members 50*a*, 52*a* each being pivotally coupled to each other wherein the first linking member 50*a* is also pivotally secured to the chassis 14 and the second linking member 52*a* is pivotally secured to the a leg member 16*a*. In this embodiment, the first linking member 50*a* can be coupled to a rear axle associated with the rear wheel such that movement of the rear wheel and axle will ultimately move the leg member 16*a* outwardly or the first linking member 50*a* can be coupled to the body 12 or an actuation member movably secured to the chassis 14.

Accordingly and when a force is applied to the rear of the vehicle 10 thereby moving the rear axle or alternatively the body 12, the linkage system is manipulated and causes one or more of the front movable leg members 16*a*, 16*b* to extend to the second position. When the force is released a spring biased force returns the linkage system to a first position and the one or more of the front movable leg members 16*a*, 16*b* are retracted to the first position.

As can be appreciated and as illustrated, actuation unit 24*c* in one non limiting exemplary embodiment, can include another pair of first and second linking members 50*b*, 52*b* that are coupled to a movable leg member 16*b*. As can be appreciated, the first actuation unit 24*c* can similarly include a linkage system associated with rear mounted movable leg members.

Figure 6A:
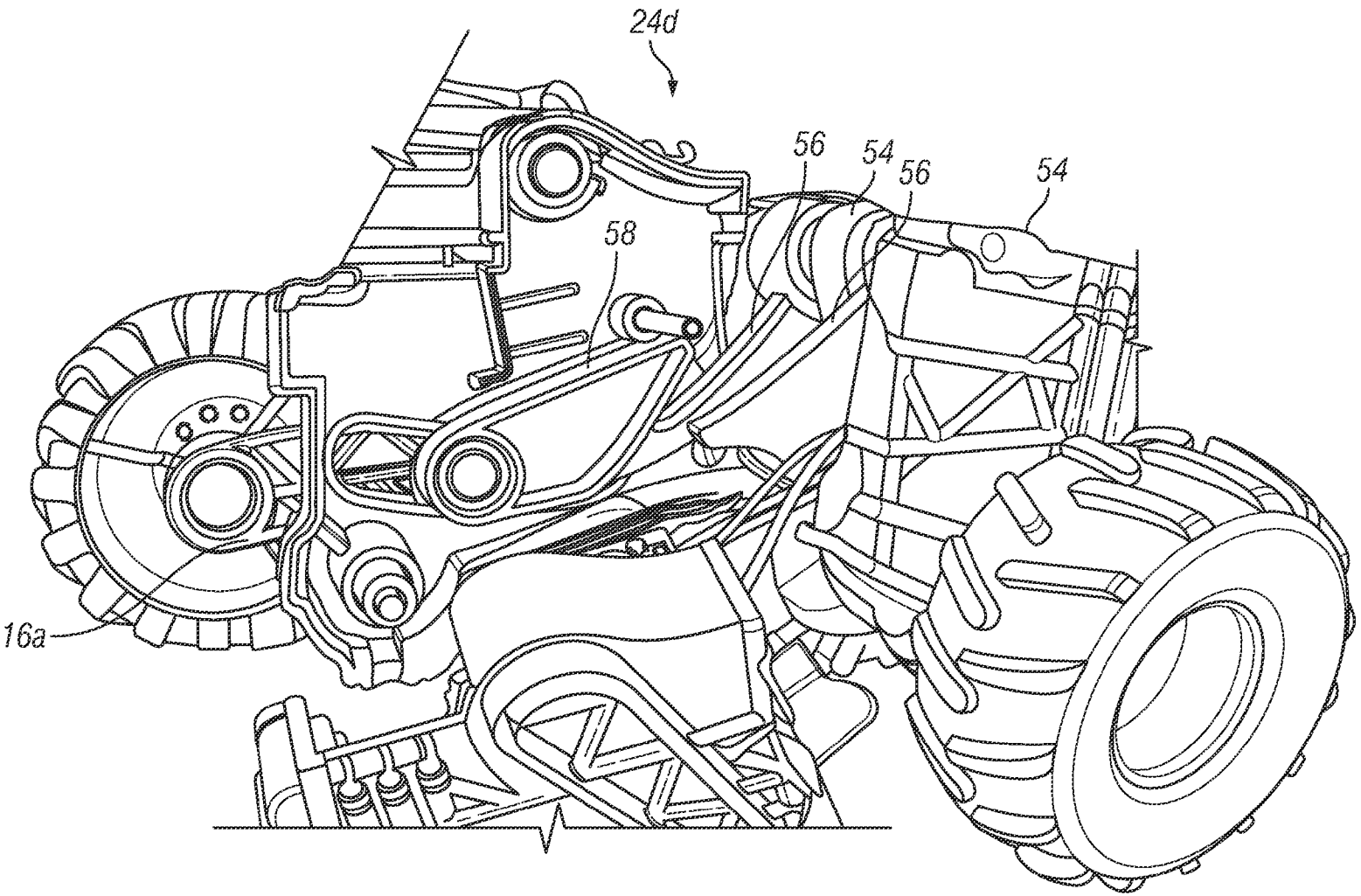
FIGS. 6A and 6B are side perspective views of still another actuation unit that actuates a vehicle feature in accordance with still another exemplary embodiment.
Figure 6B:
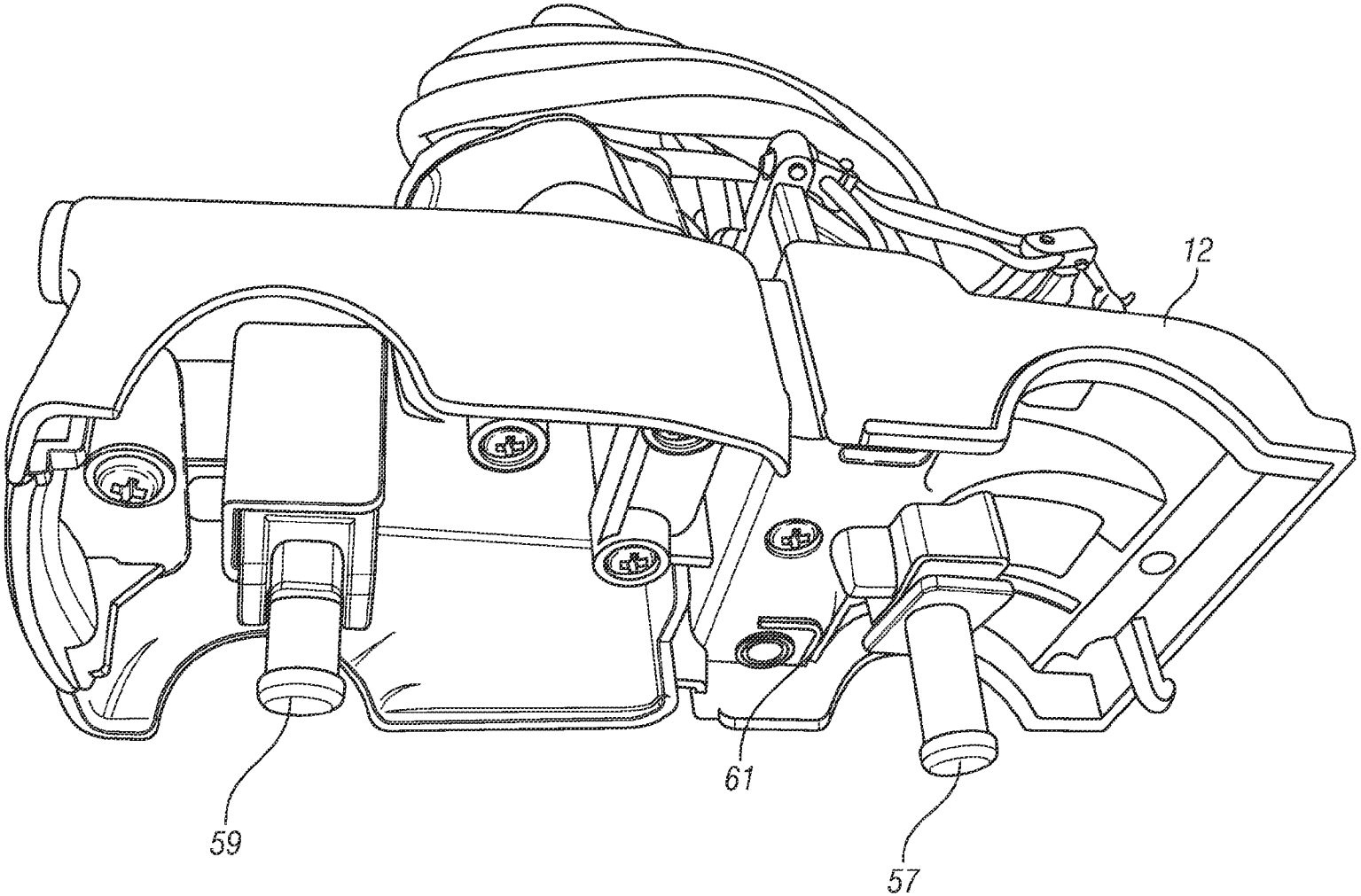

Referring now to FIGS. 6A and 6B, still another exemplary actuation unit 24*d* is illustrated that includes a cam system. For example, and in one embodiment, the actuation unit 24*d* has a first pivotally mounted cam member 56 that is spring biased in a first position. The first cam member 56 has a cam surface for engaging a corresponding can surface of a second pivotally mounted cam member 58. The second pivotally mounted cam member 58 also being spring biased into a first position. The second pivotally mounted cam member 58 is coupled to the leg member 16*a*.

A pivotally mounted lever 54 is further provided for actuating the first pivotally mounted cam member 56. The lever 54 actuates the first cam member 56 based on a force applied to the lever 54. When actuated, the first pivotally mounted cam member 56 pivots to a second position. When in the second position, the cam surface of the first pivotally mounted cam member 56 engages the surface of the second pivotally mounted cam member 58 thereby causing the second pivotally mounted cam member 58 to pivot to a second position, and further causing the corresponding leg member 16*a* to extend to a second position.

When the force is removed from the lever 54, the first pivotally mounted cam member 56 pivots back to the first position by means of the biasing force of the spring, which causes the second pivotally mounted cam member 58 to pivot back to the first position by means of the biasing force of the corresponding spring, thereby causing the leg member 16*a* to retract to the first position.

As can be appreciated, the actuation unit 24*d* in one non limiting exemplary embodiment can include another pair of cam members that are coupled to a movable leg member such that each front wheel is secured to a movable leg member spring biased into a first position and each leg member is coupled to a cam member 58 pivotally mounted to the chassis and having a cam surface positioned to engage a complimentary cam member of a first cam member 56.

In this embodiment, there are a pair of first cam members 56 each being pivotally mounted to the chassis and being configured to engage a respective cam member 58. Here each of the cam members 58 are positioned to be manipulated by a corresponding lever 54 pivotally mounted to the chassis. In this embodiment each lever is located such that if the upper body portion 12 is pushed downwardly towards the chassis in essentially a vertical direction tab member or feature 61 will engage both levers 54 and move them which in turn causes the cam member 56 to actuate cam members 58 and thus both leg members 16 are extended. Alternatively and if the body is angled with respect to the chassis as it is being depressed only one of the levers will be actuated and thus a left or right wheel and arm member is extended. Still further a user may rock the upper body portion 12 in a left to right manner with respect to the chassis such that the left and right wheels may extend and retract in an alternating fashion to resemble a punching action.

With reference to FIG. 6B, the upper body portion 12 has a pair of features 57 and 59 that allow the body to be secured to the chassis in a movable manner such that the upper body or body portion can be angled or pivoted and depressed downwardly towards the chassis at various angles such that selective movement of the levers 54 and accordingly the extension of the wheels may be provided. In one non-limiting embodiment, the features are spring biased with respect to the chassis or the upper body to allow for depression and subsequent upward movement of the upper body.

In addition, the openings the distal ends of the features are received in may be configured to allow for angular movement of the body as well as downward movement of the body so that various angles and movements are provided to provide for the selective actuation of each of the independently mounted wheels and associated leg members. Still further the features themselves may be pivotally mounted to the upper body and/or the features themselves may also be configured to be snap fitted into openings in the chassis while still allowing for the pivotal and angular movement of the body portion with respect to the chassis. Accordingly, various movement of the body with respect to the chassis allows a force to be applied to one or both of the levers in a selective fashion from a single contact or feature 61 of the body 12 such that, as discussed above, when the body12 is depressed in various directions towards the chassis 14, the body 12 applies the force to either one or both of the levers 54. When two or more levers are depressed, the application of the force to the corresponding lever 54 can in one non-limiting embodiment be dependant upon the direction of the force applied to the body 12.

Alternatively, one or more actuation buttons can be provided on the body for manipulation of the levers. In various embodiments, the force applied to the chassis 14 from the body 12 can be regulated by one or more spring biased members acting upon the upper body portion.

As can further be appreciated, the first actuation unit 24*d* can similarly include a cam system associated with rear mounted movable leg members or all four wheels of the vehicle may actuated.

Referring now to FIGS. 7 A-7B still another alternative embodiment is illustrated, here the body 12 is configured to define an interior region 60. The interior region 60 of the body 12 houses a second actuation unit 62. The second actuation unit 62 is configured to actuate or cause the movement of a front component of the body 12. In one non-limiting embodiment, the component can be, but is not limited to, a windshield 63, headlights, or a hood. In various embodiments, the component is slidably coupled to the body 12 by one or more biasing member, such as springs 65 for example, that return the component to a first position.

For example and in this embodiment, the movement can be the flipping open of the hood, flipping up of the headlights, and/or exposing a particular windshield (e.g., a second windshield or the back side of the first windshield).

Figure 7A:
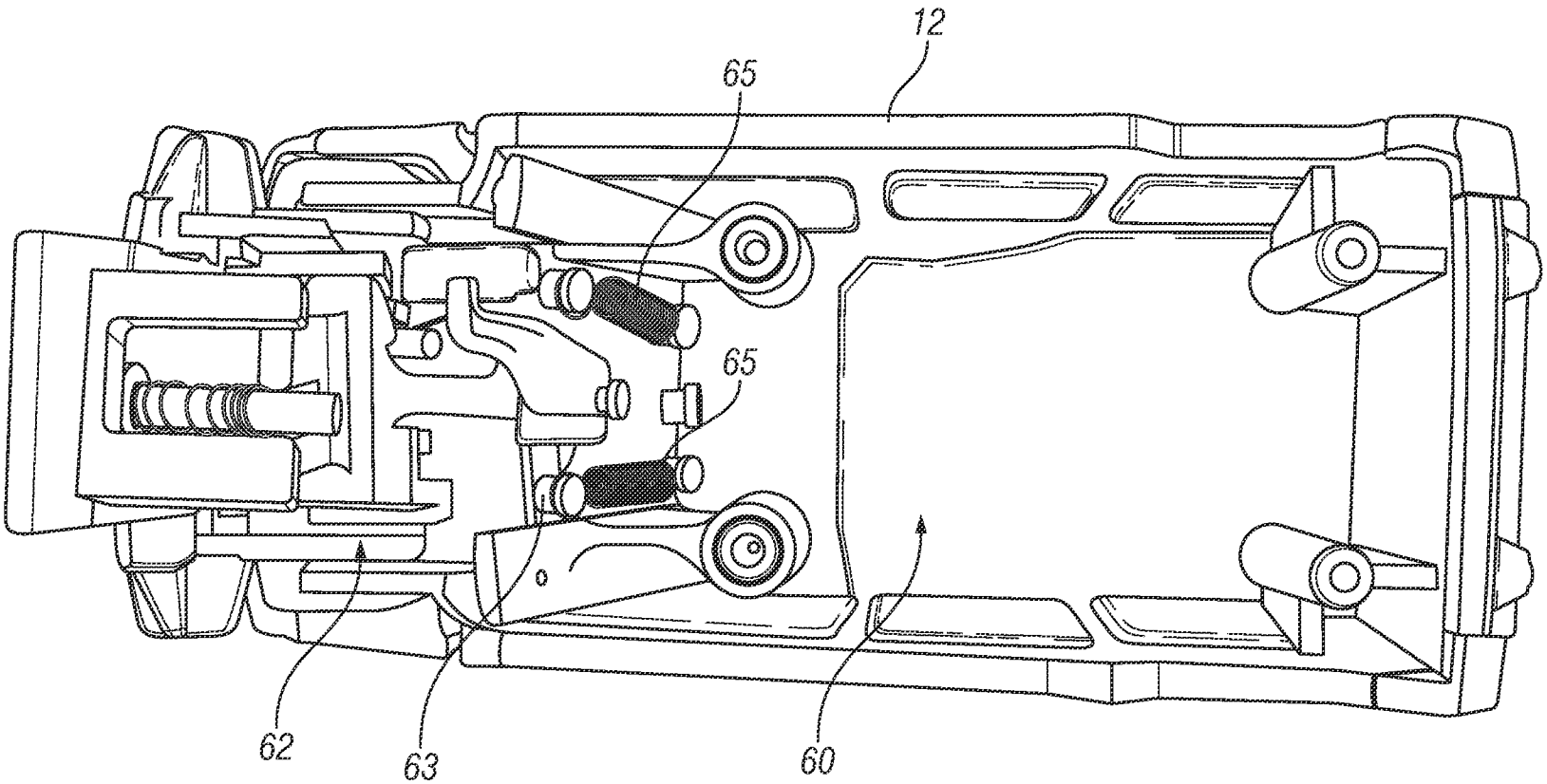
FIGS. 7A-7B are views of another actuation unit that actuates a vehicle feature in accordance with another exemplary embodiment.
Figure 7B:
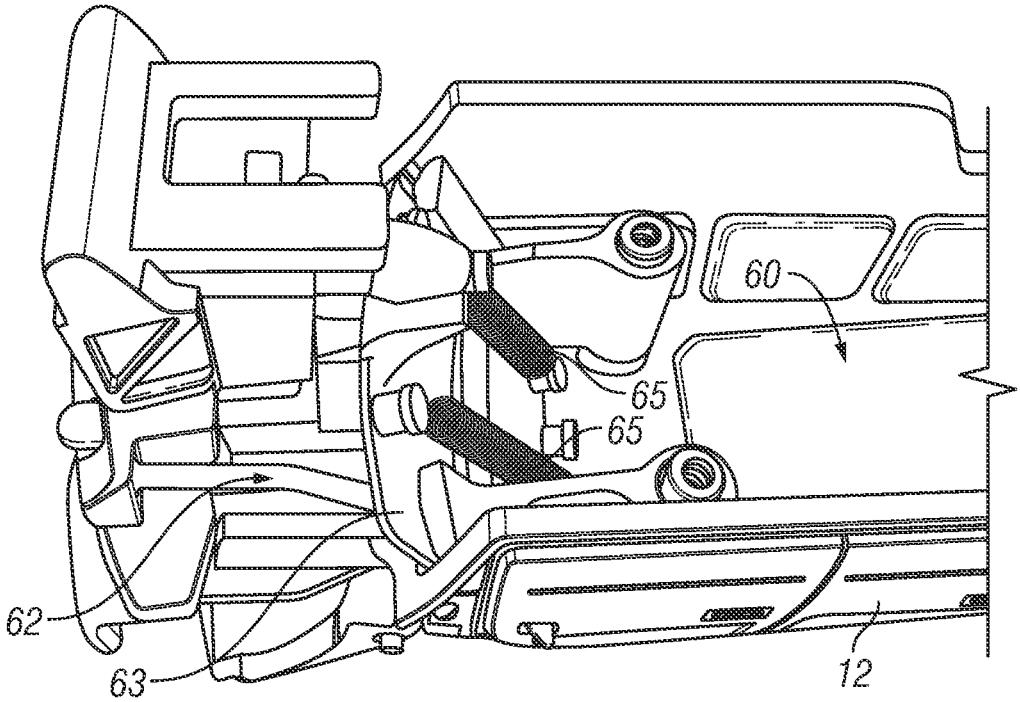

In the example of FIGS. 7A-7B, the actuation unit 62 can be coupled to, for example, a bumper of the body 12. The bumper can be spring loaded, and when depressed, can activate a linkage mechanism 62 that pulls down the first windshield and exposes the second windshield. The second windshield then displays a graphic that is different than what is displayed on the first windshield (if at all).

Figure 8A:
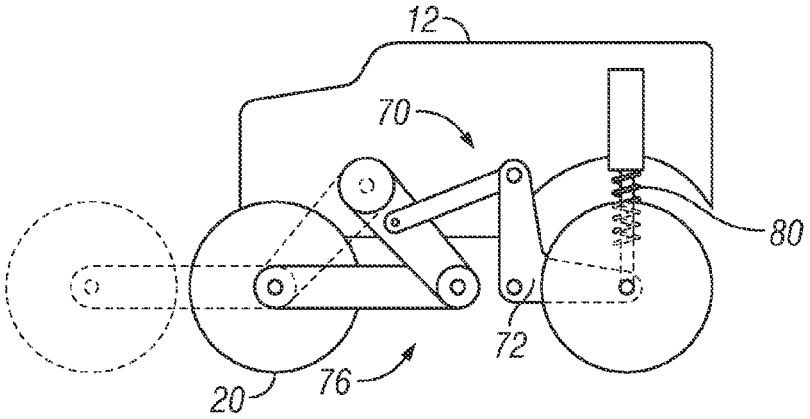
FIGS. 8A-8C are views of another actuation unit that actuates a vehicle feature in accordance with another exemplary embodiment.
Figure 8B:
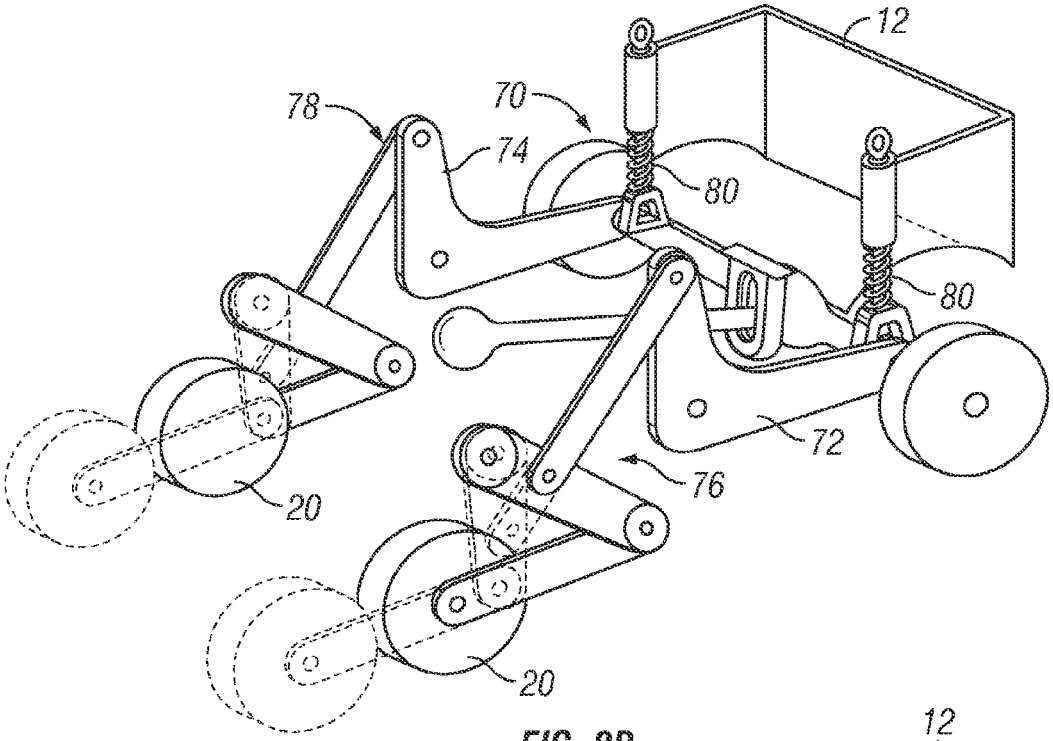
Figure 8C:
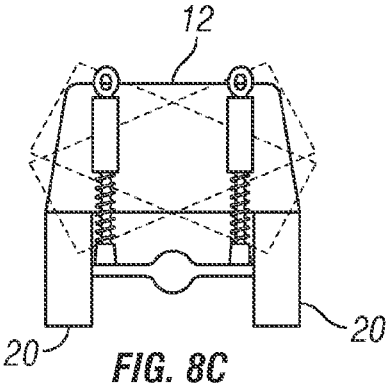

Referring to FIGS. 8A-8C still another alternative embodiment is illustrated, here the body 12 is configured to define an interior region. The interior region of the body 12 houses a third actuation unit 70. The third actuation unit 70 includes a first pair of linkages 72, 74 that rotate about a pivot in response to the body 12 being depressed. In one embodiment, the body 12 may be depressed to actuate the linkage 72 or the linkage 74 by the user depressing more on one side of the body 12 (FIG. 8C). Both linkages 72, 74 may be actuated simultaneously by depressing in substantially the center of the body 12. A biasing member, such as a spring 80, is coupled to one end of each linkage 72, 74 to return the linkage to a first position when the user releases the body 12.

The third actuation unit 70 also includes a first leg member assembly 76 and a second leg member assembly 78 that are coupled between the tires 20 and the linkages 72, 74 respectively. The leg member assemblies 76, 78 is configured to actuate or cause the movement of a front component of the body 12, such as the tires 20 for example. It should be appreciated that the leg member assemblies may further be coupled to actuate the movement of other components, such as the flipping open of the hood, flipping up of the headlights, and/or exposing a particular windshield (e.g., a second windshield or the back side of the first windshield) for example.

Figure 9:
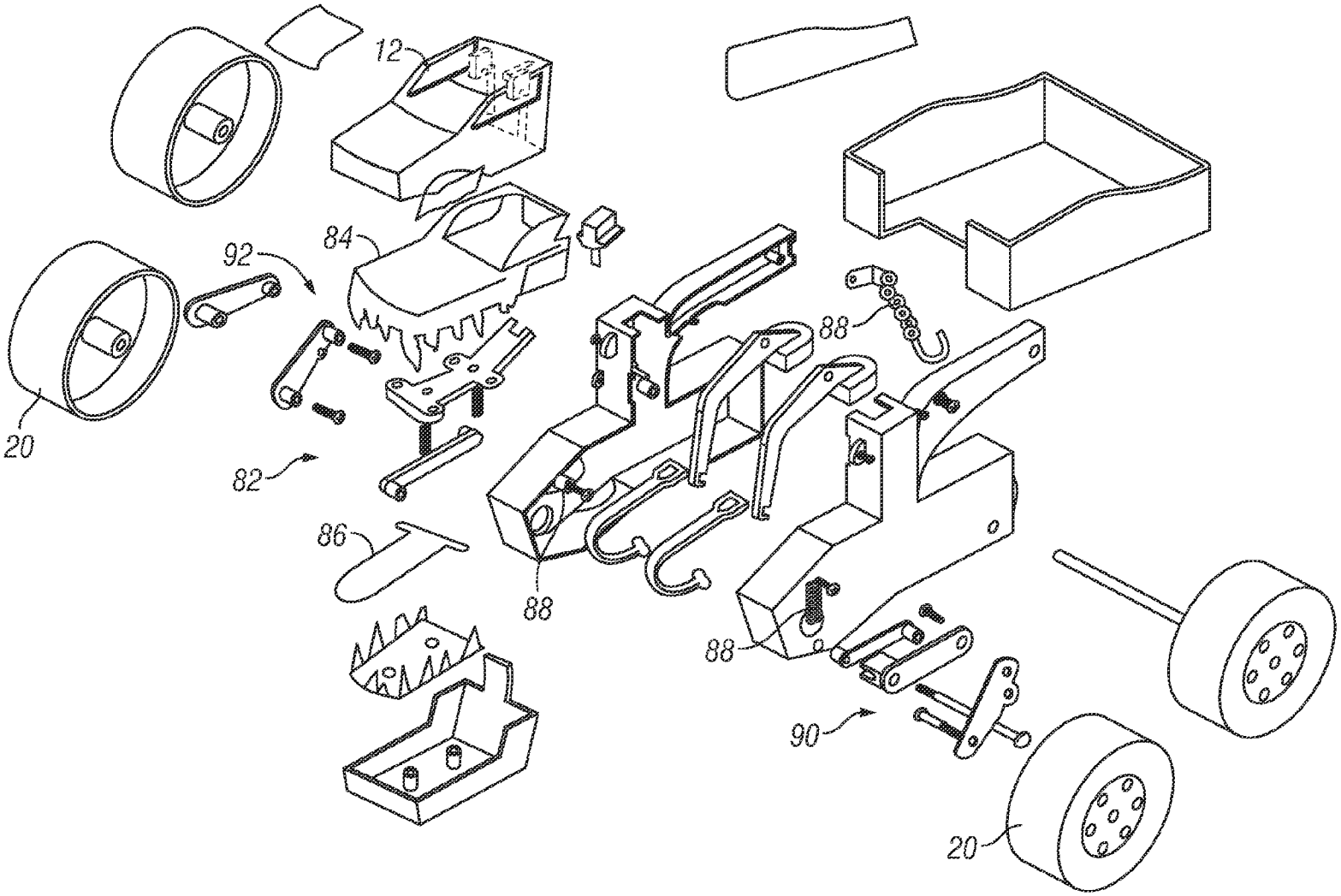
FIG. 9 is an exploded view of another actuation unit that actuates a vehicle feature in accordance with another exemplary embodiment.

Referring to FIG. 9 still another alternative embodiment is illustrated, here the body 12 is configured to define an interior region. The interior region of the body 12 houses a fourth actuation unit 82. The fourth actuation unit 82 is configured to actuate or cause the movement of a front component of the body 12. In one non-limiting embodiment, the component can be, but is not limited to, a hood 84 and a tongue member 86 that moves out from within the interior region. In various embodiments, the component is slidably coupled to the body 12 by one or more biasing member, such as springs 88 for example, that return the component to a first position.

In the embodiment of FIG. 9, the component is coupled to the tires 20 by leg members 90, 92. In response to the user moving the tires 20, such as laterally downward from the body 12 for example, the fourth actuation unit 82 leg members 90, 92 translates the movement of the tires 20 into the forward movement of the tongue 86. It should be appreciated that the movement of the tires 20 may be used to actuate the movement of other components, such as a tow truck hook 88, flipping up of the headlights, and/or exposing a particular windshield (e.g., a second windshield or the back side of the first windshield) for example.

Accordingly and in one embodiment, the toy will have a fighting feature that may include a front or rear tire side kick, a front or rear dual wheel punching effect or single wheel punching action wherein the activation method can either be pressing down on rear or front tires, pressing activation buttons located on top of the body or pressing down on the entire body to produce any of these fighting/punching features. In the various embodiments spring loaded links using anyone of gears, cams, linkages or combinations thereon allow for this action to occur.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A toy vehicle, comprising:

a vehicle chassis defining a first interior region;

a body portion movably secured to the chassis;

a leg member movably secured to the vehicle chassis for movement about an axis from a first position to a second position, wherein the leg member and a wheel rotatably secured to the leg member is moved relative to the chassis when the leg member is moved between the first position and the second position, the leg member having a gear secured to an end of the leg member for rotation about the axis, wherein rotation of the gear about the axis causes rotation of the leg member about the axis and relative to the vehicle chassis, wherein the leg member further comprises a first leg portion and a second leg portion, wherein the gear is secured to the first leg portion , the first leg portion is pivotally mounted to the second leg portion and the wheel is rotatably secured to the second leg portion;

a spring for providing a biasing force to retain the leg toward the first position; and an actuation unit received within the first interior region of the chassis and operably coupled to the movable leg member, the actuation unit being configured to overcome the biasing force of the spring and move the leg member to the second position when the body portion is moved relative to the chassis, the actuation unit including a gear portion that is engaged with the gear to drive the gear to rotate the leg member as the body portion is moved relative to the chassis.

2. The toy vehicle as in claim 1, wherein the gear is spring biased into a position corresponding to the first position of the leg member by the spring.

3. The toy vehicle as in claim 2, wherein the actuation unit includes an actuation member, and the gear is coupled to the actuation member, the actuation member being configured to be moved by the body portion.

4. The toy vehicle as in claim 1, wherein the leg member is coupled to a first cam member and a second cam member pivotally secured to the chassis, and the first cam member is actuated by the body portion when the body portion moves relative to the chassis.

5. The toy vehicle as in claim 4, wherein the first cam member is coupled to a lever pivotally mounted to the chassis, and the body portion further comprises a tab member that engages the lever and moves the leg member to the second position when the body portion is moved relative to the chassis.

6. A toy vehicle, comprising:

a vehicle chassis having a pair of wheels each independently secured to the chassis via a leg member movably secured to the vehicle chassis for movement about an axis between a first position and a second position, wherein each leg member and wheel rotatably secured to that leg member is extended away from the chassis when the leg member is moved to the second position and wherein each leg member has a gear secured to an end of the leg member for rotation about the axis, and wherein each leg member further comprises a first leg portion and a second leg portion, the first leg portion is secured to the gear at one end and pivotally mounted to the second leg portion at the other end, and the corresponding wheel is rotatably secured to the second leg portion;

a spring for providing a biasing force to retain each leg member into the first position;

a body portion moveably mounted to the chassis wherein the body portion can be moved towards the chassis in a plurality of directions; and an actuation unit received within an interior region of the chassis and operably coupled to each gear of each leg member, the actuation unit being configured to selectively extend either or both of the pair of wheels from the toy vehicle by rotating the gear about the axis and thus moving the leg members to the second position from the first position, wherein movement of the leg members from the first position to the second position is in response to the body portion being moved in one of the plurality of directions towards the chassis.

7. The toy vehicle as in claim 6, wherein the gear is spring biased into a position corresponding to the first position of the leg member by the spring.

8. The toy vehicle as in claim 7, wherein the gear is coupled to an actuation member that is configured to be moved by the body portion.

9. The toy vehicle as in claim 6, wherein each leg member is coupled to a pair of cam members pivotally secured to the chassis, and one of the cam members is actuated by the body portion as the body portion moves with respect to the chassis.

10. The toy vehicle as in claim 9, wherein one of each of the pair of cam members is coupled to a lever pivotally mounted to the chassis and wherein the body portion further comprises a tab member configured to engage the lever and move the leg member to the second position when the body portion is moved with respect to the chassis.

11. The toy vehicle as in claim 9, wherein the pair of cam members are spring biased into a position corresponding to the first position of the leg member by the spring.

* * * * *